US006127996A

United States Patent [19]

Jones et al.

[11] Patent Number: 6,127,996

[45] Date of Patent: Oct. 3, 2000

[54] MULTIPLEX ADDRESSING OF FERROELECTRIC LIQUID CRYSTAL DISPLAYS

[75] Inventors: John C. Jones; Jonathan R. Hughes; Marie H. Anderson, all of Worcs., United Kingdom

[73] Assignee: The Secretary of State for Defence in Her Britannic Majesty's Government of the United Kingdom of Great Britain and Northern Ireland, Farnborough, United Kingdom

[21] Appl. No.: 08/894,507

[22] PCT Filed: Dec. 12, 1996

[86] PCT No.: PCT/GB96/03077

§ 371 Date: Sep. 17, 1997

§ 102(e) Date: Sep. 17, 1997

[87] PCT Pub. No.: WO97/23863

PCT Pub. Date: Jul. 3, 1997

[30] Foreign Application Priority Data

Dec. 21, 1995 [GB] United Kingdom ..... 9526270

[51] Int. Cl.[7] ..... G09G 3/36

[52] U.S. Cl. ..... 345/97; 345/95

[58] Field of Search ..... 345/97, 94–96, 345/98–101, 208–210, 89; 349/172, 100, 184, 37, 34; 252/299.61, 299.63, 299.66

[56] References Cited

U.S. PATENT DOCUMENTS

| | | | |
|---|---|---|---|
| 4,793,693 | 12/1988 | Shimoda et al. | 345/97 |
| 4,800,382 | 1/1989 | Okada et al. . | |
| 5,047,757 | 9/1991 | Bone et al. | 345/97 |
| 5,136,408 | 8/1992 | Okada et al. | 345/97 |
| 5,189,536 | 2/1993 | Hanyu et al. | 345/97 |
| 5,404,237 | 4/1995 | Katsuse et al. . | |
| 5,473,338 | 12/1995 | Prince et al. | 345/94 |
| 5,684,501 | 11/1997 | Knapp et al. | 345/97 |
| 5,703,614 | 12/1997 | Mouri et al. | 345/97 |
| 5,793,347 | 8/1998 | Mugridge | 345/94 |
| 5,844,536 | 12/1998 | Okada et al. | 345/97 |
| 5,844,537 | 12/1998 | Bonnet et al. | 345/97 |

FOREIGN PATENT DOCUMENTS

| | | |
|---|---|---|
| 0 344 753 | 12/1989 | European Pat. Off. . |
| 0 370 649A | 5/1990 | European Pat. Off. . |
| 0 606 929A3 | 7/1994 | European Pat. Off. . |
| 0 621 580 A1 | 10/1994 | European Pat. Off. . |
| 2 173 335A | 10/1985 | United Kingdom . |
| 2 173 336A | 10/1985 | United Kingdom . |
| 2 173 337A | 10/1985 | United Kingdom . |
| 2271211A | 4/1994 | United Kingdom . |
| WO 92 02925 | 2/1992 | WIPO . |
| WO 95 24715 | 9/1995 | WIPO . |

OTHER PUBLICATIONS

Ferroelectrics, vol. 121, 1991, London GB, pp. 91–102, XP000560748 J.C.Jones et al.: "The importance of dielectric biaxiality for ferroelectric liquid crystal devices" see p. 94, line 13—p. 99, line 31; figures 3,4; table 1.

*Primary Examiner*—Bipin H. Shalwala
*Assistant Examiner*—David L Lewis
*Attorney, Agent, or Firm*—Nixon & Vanderhye P.C.

[57] ABSTRACT

A ferroelectric liquid crystal display comprises a layer of ferroelectric liquid crystal material contained between two cell walls, surface treated to align the material in a tilted layer. The walls carry eg row and column electrodes forming an x,y matrix of addressable elements or pixels. Multiplex addressing voltages are provided by driver circuits. An improved addressing is obtained by varying the addressing voltage applied during switching of a pixel to maximize torque applied on liquid crystal molecules. Addressing voltages are from two data waveforms and one strobe waveform; the data waveforms have more than two voltage levels, dc balance, and equivalent rms. values; the strobe waveform has two or more voltage levels (which may include a zero level). The strobe and data waveforms combine to provide a resultant voltage that form an addressing voltage at each pixel.

21 Claims, 20 Drawing Sheets

MULTIPLEX ADDRESSING OF FERROELECTRIC LIQUID CRYSTAL DISPLAYS

BACKGROUND OF THE INVENTION

1. Field of the Invention

This invention relates to the multiplex addressing of ferroelectric liquid crystal (FELC) displays.

2. Discussion of Prior Art

Such displays typically comprise a layer of a FELC material contained between two cell walls each carrying strip electrodes forming an x, y matrix of addressable elements or pixels, at electrode intersections.

One type of device is known as a surface stabilised FELC display; see for example Meyer, R B 1977 Molec. Crystals liq. Crystals 40, 33, and Clark, N A and Lagerwall, S T, 1980, Appl. Phys. Lett. 36, 899. It can be switched between two molecular orientations by a dc pulse of suitable amplitude, time, and sign. Conceptually the liquid crystal molecules can be considered as rotating around a conical surface as the material is switched.

One prior art addressing scheme uses a strobe pulse of duration two time slots (ts), and amplitude zero in the first time slot, Vs in the second time slot sequentially applied to each x row electrode in turn. Meantime one of two data waveforms are applied to each y column electrode. The data waveforms are alternative dc pulses of alternate polarity and equal magnitude (+Vd, −Vd) each pulse lasting 1ts; one data waveform is the inverse of the other. This is termed a mono pulse strobe addressing scheme.

Another addressing scheme; described in GB 2,232,802, uses a strobe waveform having two pulses each lasting 1ts in combination with data waveforms as in the mono pulse strobe scheme. The leading strobe pulse may be zero or non zero and of variable amplitude and sign. Combination of strobe and data (resultant waveform) provides two different shapes of resultant. This is useful in changing the switching characteristics of the liquid crystal material. The time taken to address each pixel in a row is the line address time (lat) and for the above scheme is 2ts.

A variation of the above is described in GB 2,262,831. In this the strobe is applied to each row in turn with a 2ts interval between applications of strobes to each new row, as in the previous scheme. Additionally the strobe waveform is extended into the addressing time of the next addressed row, ie for part of the time strobe waveforms are being applied to 2 rows at the same time.

Another addressing scheme uses 4ts to address each pixel in a time. The strobe is a zero for 1ts, then Vs for 3ts. Data waveforms are of amplitude $-V_d$, $+V_d$, $+V_d$, $-V_d$ (or the inverse) in successive time slots.

All addressing schemes must switch the material when required the difference between schemes is their performance. Performance is defined with respect to voltage used (low is desired), speed of switching (fast is desired), operating range (wide difference between selected and non selected voltages), and low dependence on pixel pattern. A high contrast between the two switched states is also advantageous; as is a wide operating range in temperature.

As noted above molecules switch from one side to the other side of a cone (eg ideally switch between ±22° to an alignment direction), due to the application of a dc voltage applying a switching torque on each molecule. This switching torque causes switching around the (imaginary) surface of a cone.

Previous addressing schemes have been empirical in nature, their design being based on the results of experimental observation. Consequently the prior art addressing schemes, and in particular the pulse shapes, have not been optimised.

SUMMARY OF THE INVENTION

This invention describes how the pulse shapes may be designed to improve switching by considering the shape of applied field as the material is switching.

The present invention improves switching performance by maximising the switching torque applied to a molecule as it rotates around the cone surface; this is achieved by varying the resultant voltage during the switching.

According to this invention a method of multiplex addressing a ferroelectric liquid crystal display is as detailed in claim 1.

According to the invention the two data waveforms have multiple levels (not just $+/-V_d$), preferably dc balance, equivalent rms. levels but not necessarily same shapes. The strobe pulse is preferably the same when used with both select and nonselect data waveforms, but may have multiple voltage levels.

According to this invention a multiplex addressed ferroelectric liquid crystal display comprises a layer of chiral smectic liquid crystal material contained between two cell walls, both surface treated to align the liquid crystal material, a first series of spaced strip (row) electrodes on one wall and a second series of spaced (column) strip electrodes on the other wall arranged to provide a matrix of addressable elements (pixels), driver circuits for applying a strobe waveform to the first set of electrodes in a sequence, and for applying one of two data waveforms (select and non-select) to the electrodes in the second set of electrodes characterised by:

means for generating a select and non-select data waveform having more than two voltage levels (which may include a zero level), the two data waveforms having dc balance and equivalent rms. values.

means for generating a strobe waveform, the two data, and the strobe waveform co-operating to provide resultant values that vary during the line address time to improve switching torque on material molecules being switched and reduce switching torque on molecules not being switched.

The data waveform may have at least 3ts and preferably more than 4ts. eg 5ts, 6ts, 7ts, 8ts or more.

The strobe waveform may be of two or more levels which may include a zero level. The first pulse in the strobe waveform may be varied in amplitude and sign to vary material switching characteristics and the waveform may extend in time into the line addressing time of another row, as in GB-2,262,831.

The display material may be addressed in two fields, with reversal of strobe polarity in alternate fields, making up a frame where the whole display is addressed to its required pattern. Alternatively the display may be blanked and then selectively switched by one strobe waveform; polarity of blanking and strobe may be inverted periodically to maintain dc balance. Blanking involves application of one or more pulses of sufficient amplitude-time product to cause a switching irrespective of what data waveform is applied to column electrodes. The blanking may be on one or more lines at a time in any desired sequence. The blanking pulse may be DC balanced with the strobe or may have extra portions to provide DC balance.

The material used in the device is one in which the value of the ratio of spontaneous polarisation (Ps) and dielectric biaxiality ($\partial\in$) is preferably less than 0.01 $Cm^{-2}$, for example than 0.001 $Cm^{-2}$.

BRIEF DESCRIPTION OF THE DRAWINGS

The invention will now be described; by way of example only, with reference to the accompanying drawings of which.

DETAILED DISCUSSION OF PREFERRED EMBODIMENTS

Figure 1:
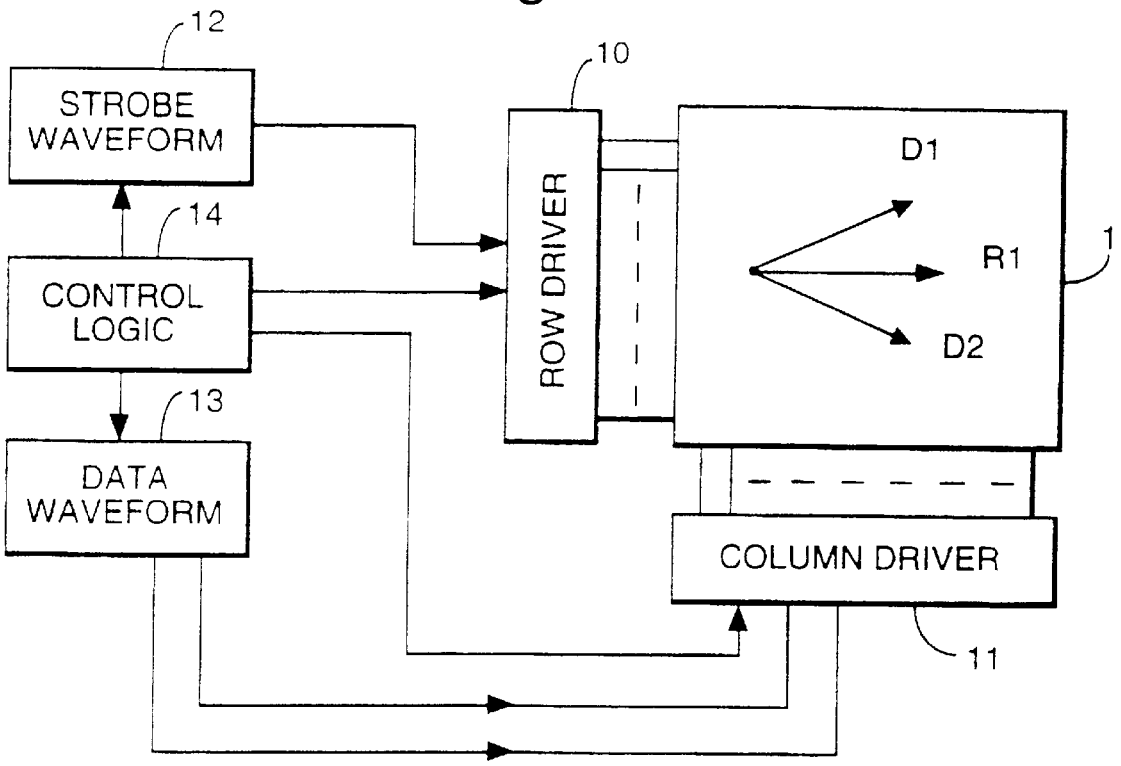
FIG. 1 is a diagrammatic view of a x, y display with row and column drivers.
Figure 2:
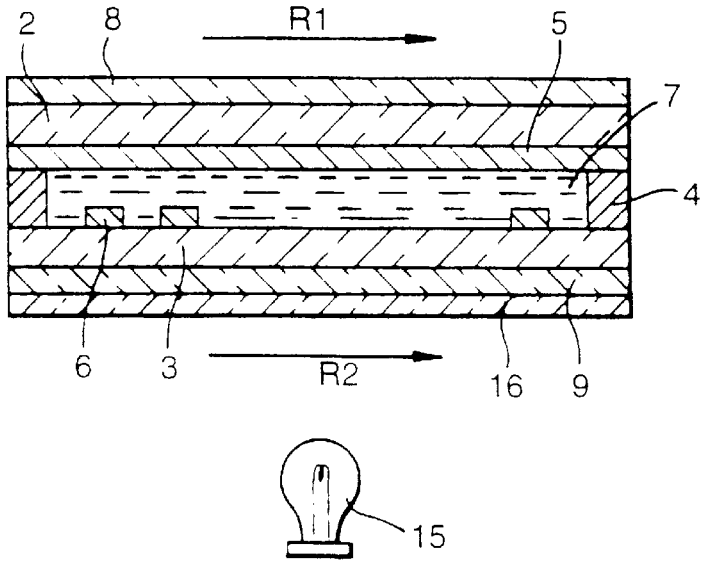
FIG. 2 is a cross section of the display cell of FIG. 1.

The display 1 shown in FIGS. 1, 2 comprises two glass walls 2, 3 spaced about 1–6 $\mu$m apart by a spacer ring 4 and/or distributed spacers. Electrode structures 5, 6 of transparent tin oxide are formed on the inner face of both walls. These electrodes are shown as row and column forming an X, Y matrix but may be of other forms. For example, radial and curved shape for an $\tau$, $\theta$ display, or of segments form for a digital seven bar display.

A layer 7 of liquid crystal material is contained between the walls 2, 3 and spacer ring 4. Polarisers 8, 9 are arranged in front of and behind the cell 1. Row 10 and column 11 drivers apply voltage signals to the cell. Two sets of waveforms are generated for supplying the row and column drivers 10, 11. A strobe waveform generator 12 supplies row waveforms, and a date waveform generator 13 supplies ON and OFF waveforms to the column drivers 11. Overall control of timing and display format is controlled by a contrast logic unit 14.

Prior to assembly the walls 2, 3 are surface treated eg by spinning on a thin layer of polyamide or polyimide, drying and where appropriate curing; then buffing with a soft cloth (eg rayon) in a single direction $R_1$, $R_2$. This known treatment provides a surface alignment for liquid crystal molecules. In the absence of an applied electric field the molecules tend to align themselves along the rubbing direction $R_1$, $R_2$ and at an angle of about 2° to the surface. The rubbing directions $R_1$, $R_2$ are parallel in the same direction as shown or may be antiparallel for some types of devices. When suitable unidirectional voltages are applied the molecular director aligns along one of two directions $D_1$, $D_2$ depending on polarity of the voltage. Ideally the angle between $D_1$, $D_2$ is about 45°, but varies with material.

The device may operate in a transmissive or reflective mode. In the former light passing through the device eg from a tungsten bulb 15 is selectively transmitted or blocked to form the desired display. In the reflective mode a mirror 16 is placed behind the second polariser 9 to reflect ambient light back through the cell 1 and two polarisers 8, 9. By making the mirror 16 partly reflecting the device may be operated both in a transmissive and reflective mode.

Figure 3:
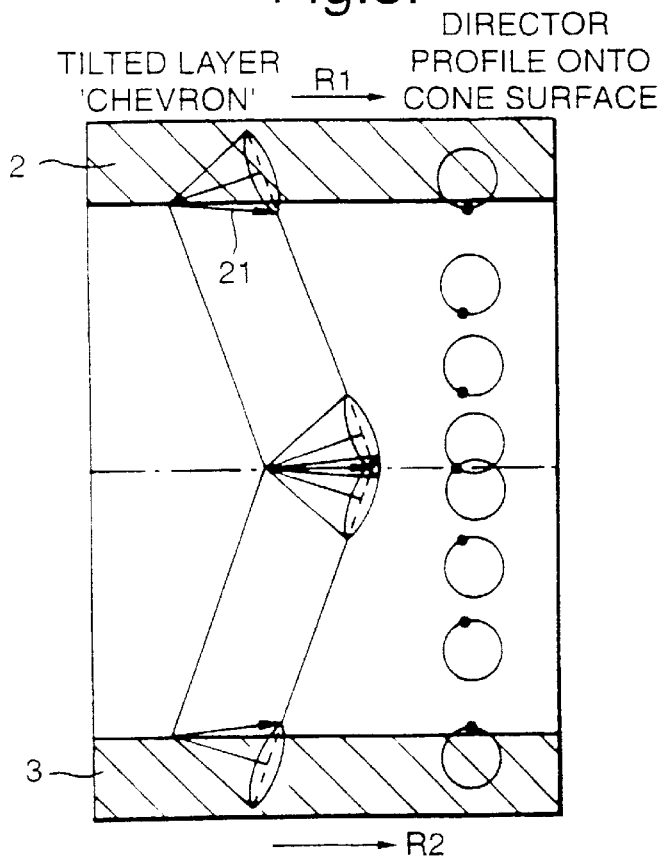
FIG. 3 is a schematic view of a layer of ferro electric liquid crystal material showing one of a number of possible alignment configurations.
Figure 4:
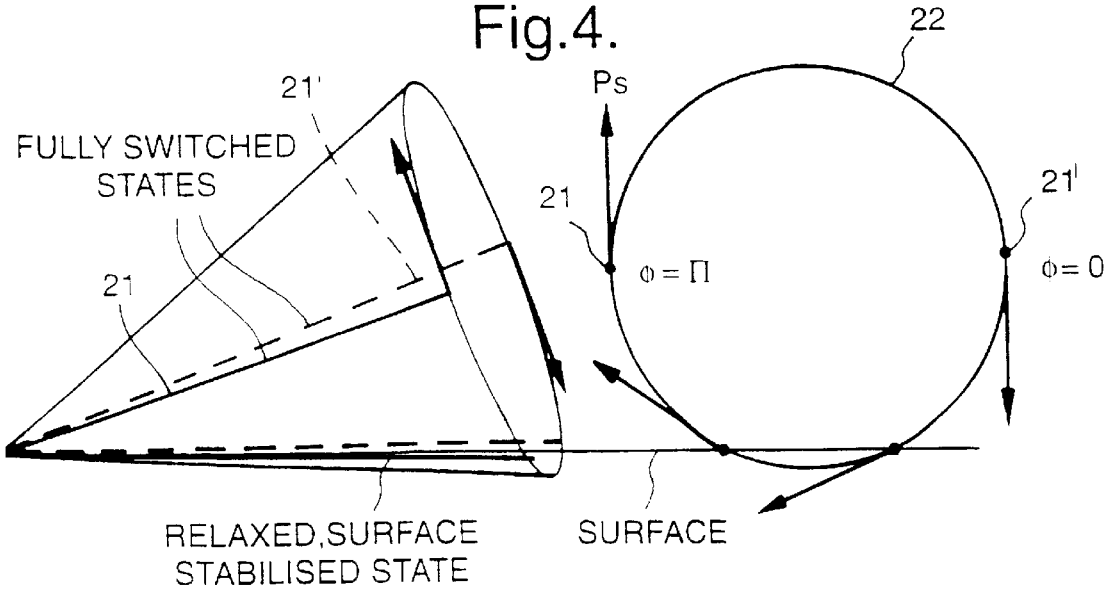
FIG. 4 is a schematic view showing one of the two allowable bistable positions of an LC molecule and its envelope of movement around the imaginary surface of a cone.

FIG. 3 shows diagrammatically one arrangement of liquid crystal molecules 21 in a layer. Molecules (more correctly the director) tend to lie as if on the surface of a cone 22, seen more clearly at FIG. 4. Adjacent to the cell walls 2, 3 strong aligning forces anchor the molecules in a tilted and aligned direction, away from the walls the molecules tend to arrange themselves as shown in one of two stable positions 21, 21'. When a dc electric field of appropriate polarity is applied there is a coupling between the molecule and the field and the molecules rotate around the cone 22 from one switched position 21 (shown in solid lines) to the other switched position 21' (shown in broken lines).

The present invention improves switching by aiming to maximise torque to the molecules during switching by varying the amplitude of applied field during switching.

Figure 5:
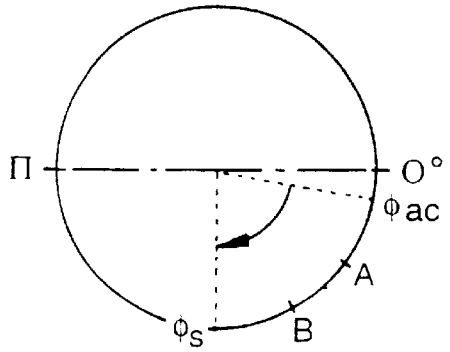
FIG. 5 is an end view of FIG. 4 indicating several positions of a liquid crystal molecule during switching.
Figure 6A:
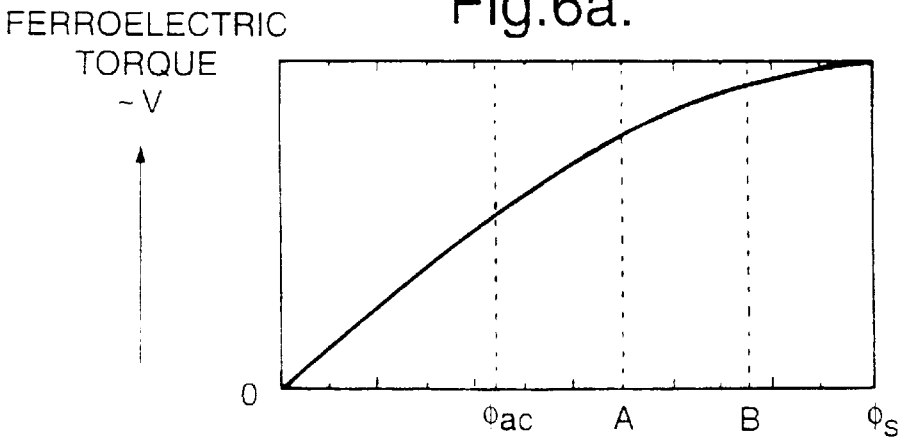
FIGS. 6*a*, 6*b* show ferroelectric and dielectric torque respectively against positions of the liquid crystal molecules in FIG. 5.
Figure 6B:
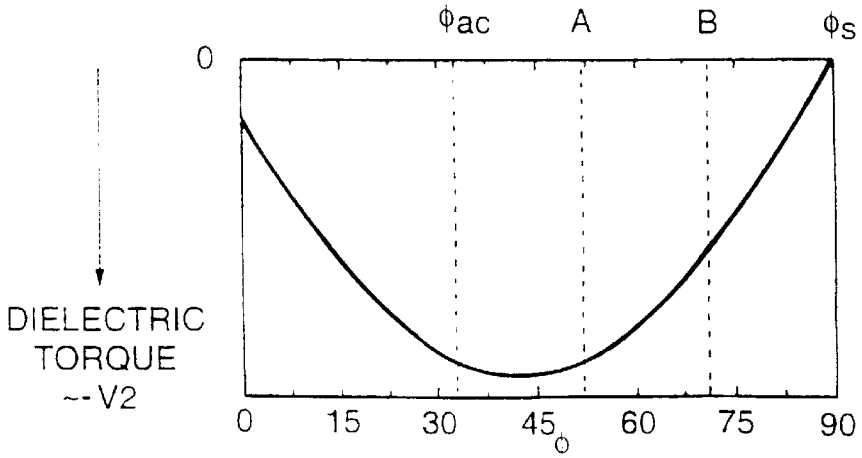

FIGS. 5, 6*a*, 6*b*, show how torque varies as a molecule moves from $\phi$ac (position under ac stabilised voltage) through A, B to $\phi$s, which is halfway between its two switched states, (thereafter it continues to move to its other switched position $\phi$ac'). There are two different torques acting on the director, the ferroelectric torque and the dielectric torque. The ferroelectric torque, FIG. 6*a*, is the force proportional to applied voltage acting on the director making it rotate round the cone surface 22. The dielectric torque, FIG. 6*b* is a torque tending to resist movement of the director and is proportional to V2. To improve molecule switching, the voltage applied to the material is arranged so that the switching torque (difference between ferroelectric and dielectric torque) is maximised as the director switches from ϕac, through A, B and ϕs for pixels needing to be switched. For pixels required not to switch, then the switching torque is minimised.

Figure 7A:
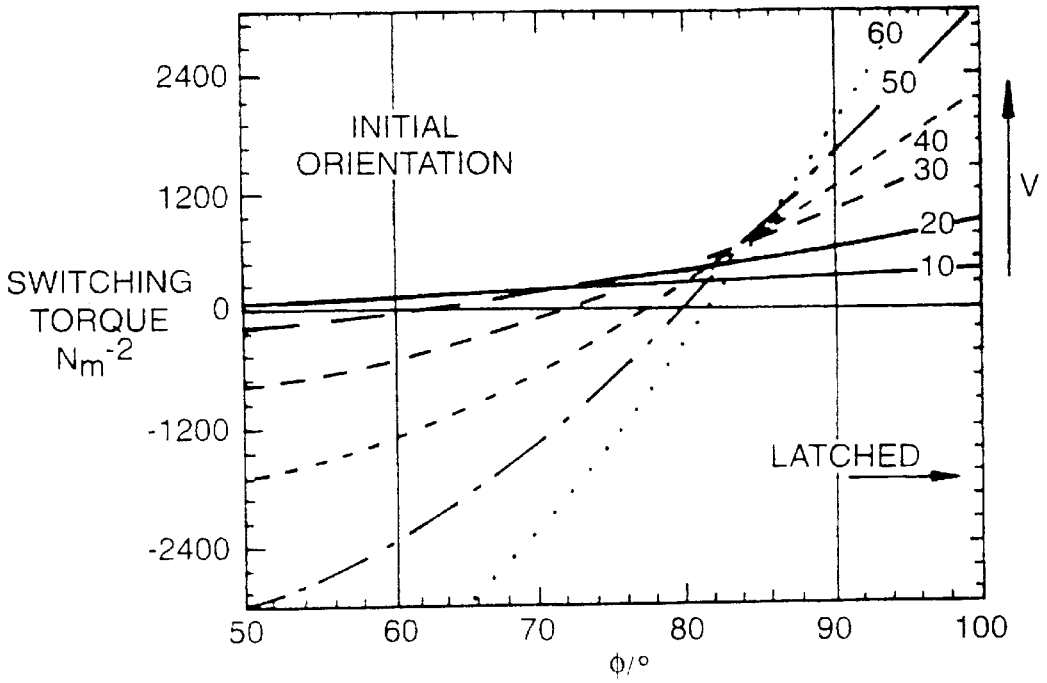
FIGS. 7*a*, 7*b* shows switching torque and voltage against director position around a switching cone.

As seen in FIG. 7*a*, prior to switching the director has an angle of say 50° from zero. Application of a relatively small voltage of 10v results in a small positive switching torque, and the director starts to move. At around 74° the voltage can be increased to 20v, then at about 82° and more the voltage increased to 30v, 40v etc up to 60v as indicated by the FIG. 7*a*. In contrast if the initially applied voltage is large, eg 50v then the switching torque would be large and negative because the dielectric torque predominates over the ferroelectric torque thereby slowing down switching.

An explanation of how the present invention improves the performance of multiplexed devices follows particularly with reference to FIGS. 5, 6*a* and 6*b*. FIG. 5 illustrates the plan view of the cone of possible orientations for the director. The liquid crystal moves about this cone through changes in the orientation angle ϕ only in response to the applied electric field. The actual device configuration from one surface to the other is complicated, depending on the alignment and applied electric field. For simplicity, a uniform structure is assumed in which the director is at some orientation ϕ throughout the sample. Switching occurs when the electric field results in a net torque on the molecules tending to change ϕ. How rapid the switching is depends on the magnitude of the torque and the total change in orientation through which the molecules move. Ferroelectric liquid crystal devices switch as a result of a net DC field favouring one side of the cone (either left or right in FIG. 5). The starting orientation is ϕac (resulting from the AC field effect usually from the data waveform) and switching occurs when a net DC of the correct polarity tends to cause reorientation towards ϕs (once the director has passed ϕs the pixel will have latched and will relax to the other side of the cone, in this example the left hand side, on removal of the DC voltage).

The applied DC results in a switching torque which has the form shown in FIG. 6*a*. This torque is linear in V and is polarity dependent—the higher the applied DC voltage, and/or duration of application, the faster the switching. However, the ferro electric liquid crystal (FLC) also has a contribution to the torque from the dielectric properties as shown in FIG. 6*b*. These tend to minimise the electrostatic free energy at some value of Φac usually close to 0° or 180°, and the torque is related to $V^2$ (and is polarity independent). For typical ferroelectric materials, the dielectric terms ($\epsilon_0$.E $\underline{\epsilon}$E) are smaller than the ferroelectric term ($P_s$E) except at high fields. Thus, as the field is increased the device becomes faster until a minimum, where the effect of the dielectric terms slows the device. This is the cause for the minimum in the ιV curve.

Ignoring elastic and inertial torques, the torque on the director Γ is given by:

$$\Gamma = \eta\frac{d\phi}{dt} = P_S\frac{V}{d}\sin\phi - \varepsilon_0\frac{V^2}{d^2}\left[(\Delta\varepsilon\sin^2\theta - \partial\varepsilon)\cos^2\delta\sin\phi\cos\phi - \frac{\Delta\varepsilon}{4}\sin 2\theta\sin 2\delta\cos\phi\right]$$

FIG. 7*a* shows the director orientation ϕ dependence of the torque for voltages between 10 V and 60V for the material and cell parameters from table 1. Positive values of Γ cause ϕ to move towards 90°, whereas negative values move the director towards the AC field stabilised condition ϕac.

TABLE 1

Cell and Material Parameters used to calculate switching torque

| Symbol | Parameter | Value |
|---|---|---|
| d | cell spacing | 1.5 μm |
| θ | cone angle | 22.5° |
| δ | smectic layer tilt angle | 20° |
| ∂ϵ | dielectric biaxiality | +1.0 |
| Δϵ | Uniaxial dielectric anisotropy | −1.0 |
| $P_S$ | Ferroelectric Spontaneous Polarisation | +5 $nCcm^{-2}$ |

The reasoning behind the present invention lies in the fact that, for a given director orientation there is a switching voltage which gives maximum torque given by:

$$V_{d\Gamma/d\,V=0} = \frac{P_S d\cdot\tan\phi}{2\varepsilon_0(\Delta\varepsilon\sin^2\theta - \partial\varepsilon)\cos^2\delta\sin\phi - \varepsilon_0\frac{\Delta\varepsilon}{2}\sin 2\theta\sin 2\delta}$$

Moreover, there are voltages for which there is no switching torque, either for the trivial case

V=0 or when the ferroelectric and dielectric torques are balanced and in opposition:

$$V_{\Gamma=0} = \frac{P_S d\tan\phi}{\varepsilon_0(\Delta\varepsilon\sin^2\theta - \partial\varepsilon)\cos^2\delta\sin\phi - \varepsilon_0\frac{\Delta\varepsilon}{4}\sin 2\theta\sin 2\delta}$$

which is twice the voltage required for maximum torque. The ϕ dependences of these three conditions are shown in FIG. 7*b*.

For a given director orientation ϕ there is a range of voltages over which the switching torque varies between zero through maximum and back to zero again. Outside this range the switching torque is zero. The width of this range varies with ϕ as shown in FIG. 7*b* as a hatched area with the value of maximum torque shown by a solid line, and the limits of zero torque shown in dotted lines.

Figure 7B:
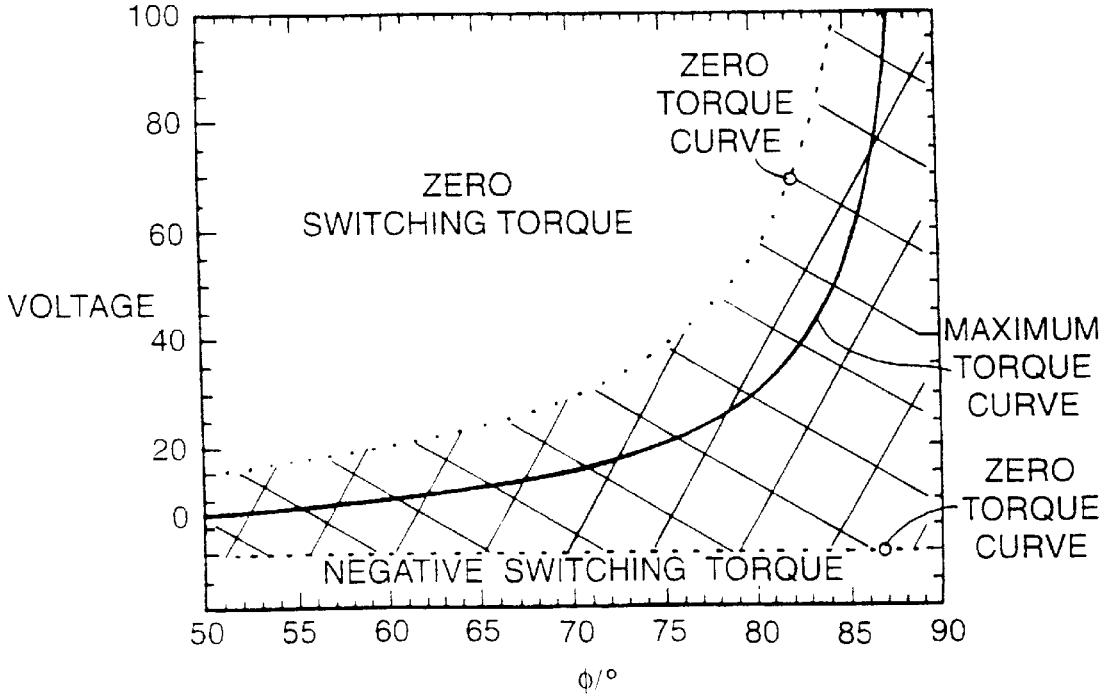

For fastest switching of a pixel during a line address time (lat) the voltage applied to a pixel (the resultant of strobe and data) should follow the maximum torque curve shown in FIG. 7*b*.

For a pixel not required to switch then there are three possible solutions. These are: (i) zero voltage which gives zero switching torque (but is impractical because of the strobe applied to all pixels in a line); (ii) a voltage tending to move the director in a direction opposite to a required switch direction; and (iii) a voltage sufficiently high (or low) that zero (or insufficient) switching torque is generated at the pixel. In practice a combination of (ii) and (iii) can be used as described later, FIGS. 8,9 so that the switching torque is sufficiently far away from the maximum curve during addressing that the pixel does not switch.

A device is multiplexed such that a strobe voltage is applied a line at a time, causing switching of pixels with one data waveform, but not those with another. Discrimination between the Select (S) and Non-select (NS) pixels is due to the data voltage alone, since the same strobe is applied along the whole column. Conventional schemes use S and NS data forms which have the same shape but are of opposite polarity. The prior art scheme of FIG. 11 operates with two time slots in the following fashion:

$$(0,1)Vs+(1,-1)Vd$$

and $$(0,1)Vs-(1,-1)Vd$$

Figure 11:
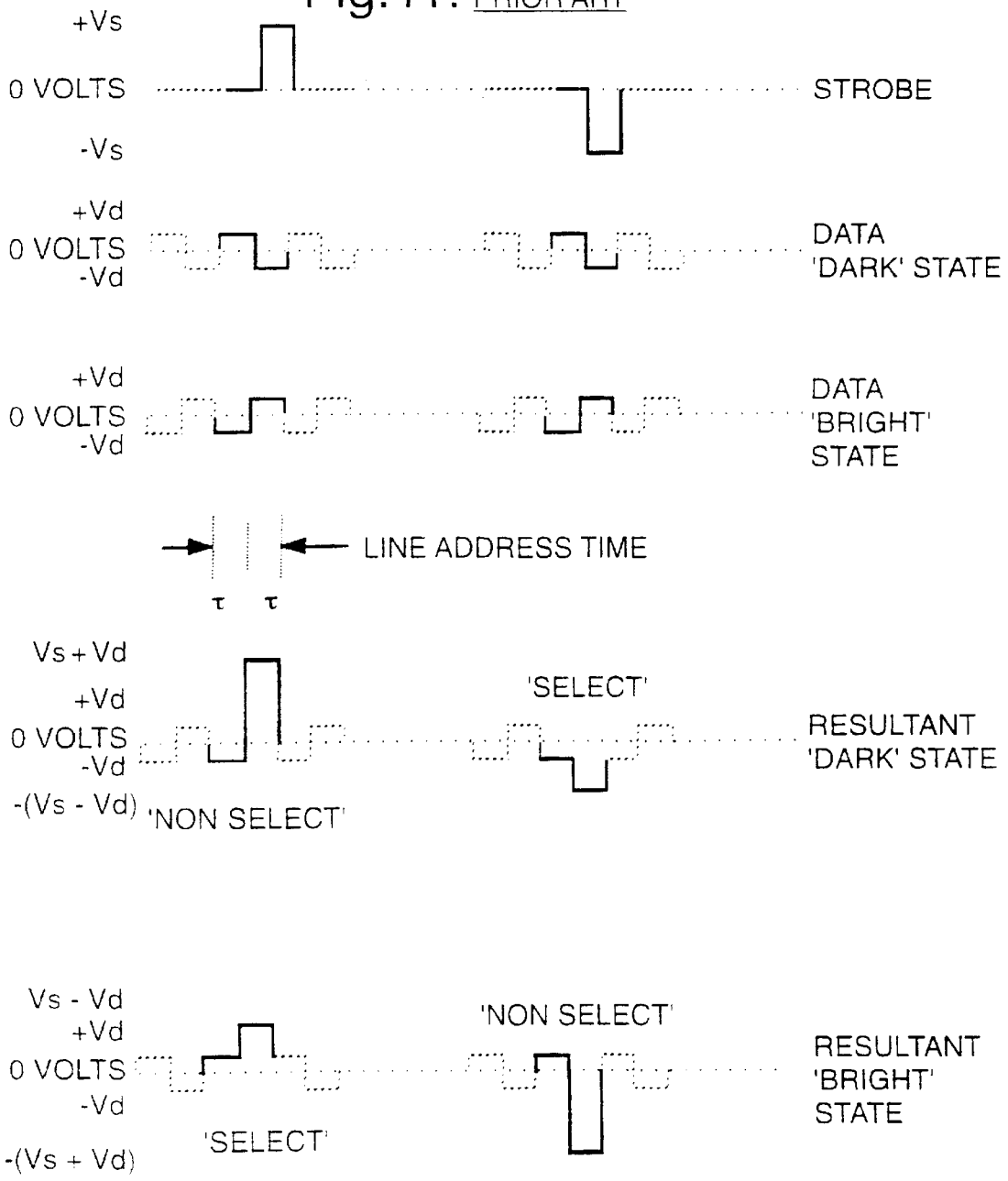
Fig.11. PRIOR ART
FIG. 11 shows a strobe, two data, and two resultant waveforms of a prior art addressing scheme.

These schemes may be abbreviated to 01_11, where the first figures represent the strobe levels over the two slots and the second figures represent the data voltages, FIG. 11. In all of the schemes discussed the data waveform is DC balanced over one line address time (important to prevent electric breakdown of the liquid crystal and unwanted switching over several frames with the same pixel pattern). Thus it is unnecessary to specify the polarity of the data waveforms in this abbreviation. Another type of scheme is the scheme represented by 0111_1111.

The FIG. 11 scheme is prior art which is best applied to materials with τV minima, and works in the following fashion. The strobe voltage includes a zero in the first part of the time slot, and the resultant therefore has a prepulse of either ±Vd, then followed by a slot of Vs±Vd. Operating close to the τV minimum gives the select pulse a resultant of (+Vd,Vs−Vd) and the non select a resultant of (−Vd,Vs+Vd). The prepulse Vd will either begin to switch the director from its initial state towards either of the DC switching conditions $\phi=0$ or $\phi=90°$ depending on its polarity. When Vs is then applied, the director is no longer at it initial position $\phi ac$ but is either at position A for the select pulse (FIG. 5) or at $\phi=0$ for the non select. This automatically leads to improved discrimination between S and NS waveforms. Switching then results from the Vs−Vd part of the resultant, but not Vs+Vd.

The aim of the schemes of the present invention is to provide data waveforms which in conjunction with the applied strobe voltage either leads to the maximum torque throughout the switching process for pixels to be latched into the opposite state (leading to the fastest response), or the lowest torque practical for pixels which should remain unchanged (for widest discrimination). In these schemes both Vs and Vd may have multiple voltage levels applied over three or more time slots. This enables much greater control over the precise shape of the resultant waveforms and therefore closer to optimum speed, voltage and operating range. The larger the number of slots used the greater the degree of control and the closer to optimum performance will be possible.

The simple picture described above for the FIG. 11 scheme assists in seeing how to optimise resultant shape, namely:

(i). The prepulse leads to good discrimination. The higher this is (or the longer its duration) the further round the cone the director moves before receiving the part of the strobe at Vs and the wider the operating range will be.

(ii). The majority of the switching is done by the part of the strobe at the level Vs (note this may be extended into the following lines, as in a prior art scheme referenced above). It must be of sufficient duration and amplitude to give fast operation (preferably about τVmin) but it is applied across both S and NS pixels and discrimination is solely due to Vd. Thus, there is a trade off between line address time and operating range.

Figure 8:
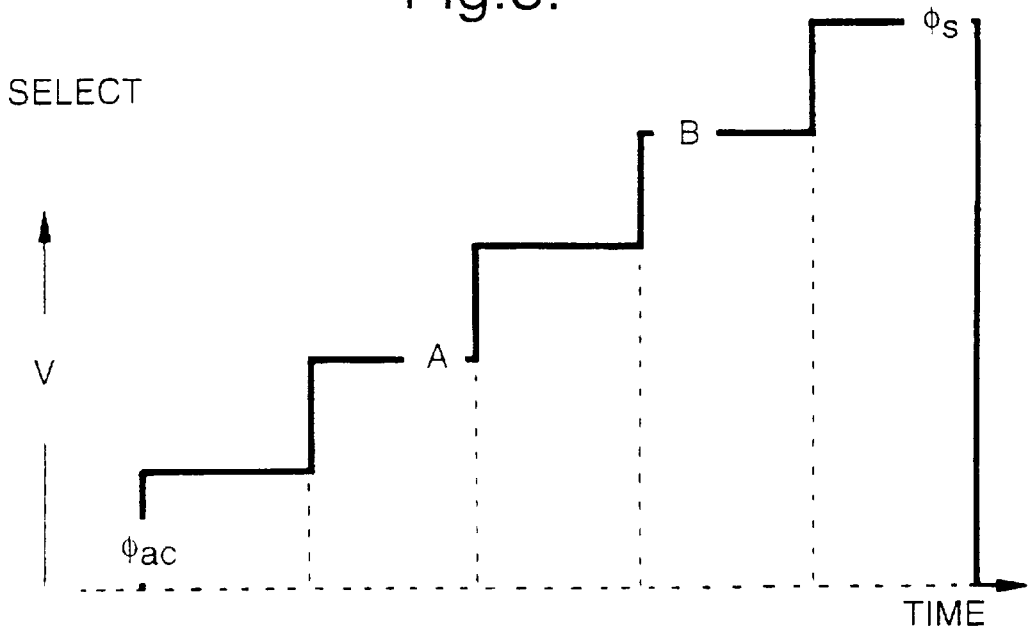
FIG. 8 shows an example of resultant waveform suitable for switching the material in FIG. 5.
Figure 9:
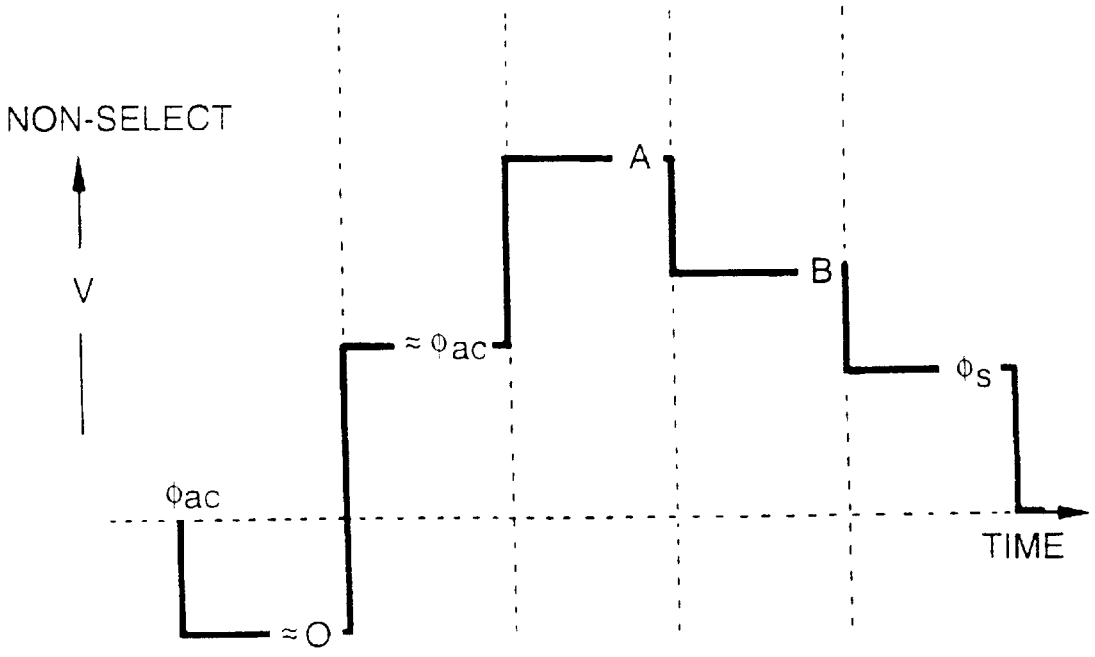
FIG. 9 shows a resultant waveform, for use with waveform of FIG. 8, which does not cause switching.

FIGS. 8 and 9 are resultant voltages which show how to approach optimum performance with five slot time slots to illustrate the method of designing improved schemes. Assume that positive voltages induce switching towards $\phi=180°$. Consider the select pulse of FIG. 8. This is designed to approach the maximum torque shown in FIG. 7*b* in each time slot. The starting condition is set by the alignment of the liquid crystal, the RMS voltage (which causes AC field stabilisation) and the effect of the data waveform from the previous line(s). This starting condition is typically about 60°, and as FIG. 7*b* illustrates, the switching torque is maximum for a relatively low voltage (because at this orientation the contribution from the dielectric torque is strong, FIG. 6*b*). As the director begins to switch towards $\phi=90°$, the dielectric torque becomes increasingly less important and the maximum switching torque is reached at a higher voltage. Thus, a resultant waveform of the form shown in FIG. 8 is required for switching.

The widest operating range then results if the pixels that should remain unchanged (Non-selected) receive either zero (or less) volts, or greater than the voltage given by equation 4 above. The latter may be impractical since the same strobe voltage must also lead to a resultant which gives close to the maximum torque. Operation close to either of the zero torque loci for the non-select resultant is what is required. An example of such a waveform is shown in FIG. 9. If the drive scheme is designed to operate with a pre-pulse (negative for the NS resultant) the director will be partly switched from its initial condition towards $\phi=0°$, say at 40°. Here, the dielectric torque is relatively low and a relatively low voltage gives zero torque. As the director moves back round the cone towards $\phi=90°$ the voltage which gives the lowest torque increases. At some point, the voltage which has the lowest torque according to equation 4 will become impractical., and so decreasingly small voltages may be used to ensure the torque is kept minimum.

In practice, the data waveforms must be DC balanced within each line address period and the select and non-select waveforms should have the same RMS voltage level to prevent contrast variations across the display. In the nomenclature of the present invention this is assumed implicitly. Examples of some schemes of the present invention schemes are shown in table 2. These schemes all use a zero in the first slot of the strobe together with a high level in the data voltage to give good discrimination. In this manner, the discrimination may be improved with a relatively low RMS voltage level.

TABLE 2

Examples of three slot schemes.

| Invention scheme | Select Resultant | Non-select Resultant | Vrms of data |
|---|---|---|---|
| 011_110 | +Vd,Vs − Vd,Vs | −Vd,Vs + Vd,Vs | $(\sqrt{2})/3 \cdot Vd$ |
| 011_321 | +3Vd,Vs − 2Vd,Vs − Vd | −3Vd,Vs + 2Vd,Vs + Vd | $(\sqrt{14})/3 \cdot Vd$ |
| 011_312 | +3Vd,Vs − Vd,Vs − 2Vd | −3Vd,Vs + Vd,Vs + 2Vd | $(\sqrt{14})/3 \cdot Vd$ |

TABLE 2-continued

Examples of three slot schemes.

| Invention scheme | Select Resultant | Non-select Resultant | Vrms of data |
|---|---|---|---|
| 011_312_321 | +3Vd,Vs − Vd,Vs − 2Vd | −3Vd,Vs + 2Vd,Vs + Vd | (√14)/3 · Vd |
| 011_532 | +5Vd,Vs − 3Vd,Vs − 2Vd | −5Vd,Vs + 3Vd,Vs + 2Vd | (√38)/3 · Vd |
| 012_312 | +3Vd,Vs − Vd,2Vs − 2Vd | −3Vd,Vs + Vd,2Vs + 2Vd | (√14)/3 · Vd |

The precise form of the voltage which leads to the best performance will vary according to the material, the alignment and the temperature of the cell. It is important to provide means of compensating for temperature changes of the display. Prior art methods such as changing the magnitude of either Vs or Vd, or strobe extension into the following lines are equally applicable to these schemes. However, additional (and novel) methods are also available with these schemes, including changing the shape of either (or both) data waveforms, the shape of the strobe waveform, changing the number of slots (eg 011_110 to 0111_1100 to 01111_11000 etc. with changing) and any combination of these.

Two resultant waveforms for improving the switching (select) and non-switching (non-select) for the rotation shown in FIG. 5 are shown in FIGS. 8, 9. At commencement of the resultant voltage, the director has a low value of ϕac, and a low voltage is applied, FIG. 8. The voltage is increased in steps whilst the director moves through positions A, B, and ϕs; thereafter it continues to move to ϕac' without further application of a voltage. The resultant voltage for a pixel not required to switch is shown in FIG. 9. Initially the voltage is small and negative which causes some movement of the director in the wrong direction. Thereafter the voltage is increased until the director is in the ϕA position. Thereafter the resultant is reduced. The net effect of this FIG. 9 resultant is that the dielectric torque dominates thus hindering switching.

Figure 10:
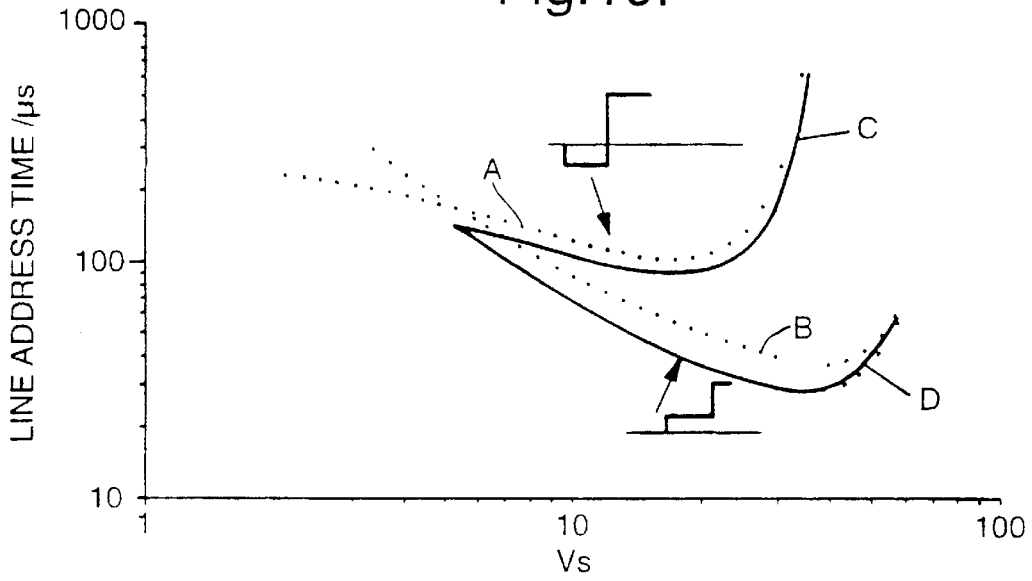
FIG. 10, is a graph showing switching characteristics for one material with the two different addressing schemes shown in FIGS. 11 and 12.

FIG. 10 shows switching characteristics , τ (time taken to switch) and V (applied voltage) for chiral smectic material under two different addressing schemes; a prior art scheme indicated in dotted lines, and one scheme of the present invention. Material switches on the product of applied voltage and time. Above the curves the material will switch. As shown the material is also sensitive to the shape of applied voltage waveform; the upper curves A, C apply for a waveform having a small pulse of one polarity followed by a larger pulse of the opposite polarity; the lower curves B, D apply for a waveform having a small pulse of one polarity followed by a larger pulse of the same polarity. Thus it is necessary to consider the shape of the waveform as well as the voltage time product.

In the prior art scheme of FIG. 11 (a two slot scheme) strobe and data waveforms present during one line address time are shown in full lines; the strobe is zero outside the line address period; the data may be either select 'dark' or select 'bright' in other line address periods and only one possibility is shown. The strobe waveform is zero volts for one time slots (1ts) then +Vs for 1ts is applied to successive rows in turn whilst one of two data waveforms are supplied to each column. Data waveforms are alternate pulses of +Vd and −Vd each lasting 1ts, with one data waveform the inverse of the other.

Data A (ie non-select or dark state) will not cause a switching when combined with the (positive) strobe; Data B, (ie select or bright state), will cause a switching when combined with the (positive) strobe. After all rows have been addressed by the strobe shown, ie one field time, the polarity of the strobe waveforms are inverted and all rows addressed in a second field time; select data now becomes non-select data and non-select now becomes select data.

Two field times are needed to completely address a display and this is the frame time. The strobe shown will address selected pixels, at row and column intersections, to say D1 (FIG. 1) or the up-state (in combination with data B), whilst its inverse will switch selected pixels to a D2 or down-state (in combination with data A).

Resultant voltages for positive strobe and data dark are $(-V_d)$; $(V_{s+}V_d)$ which does not switch; and positive strobe with data light are $(+V_d)$; $(+V_s-V_d)$ which switches. Resultant voltages for negative strobe and data are the reverse, ie the negative strobe switches in combination with the data dark waveform but not with the data light waveform. Switching characteristics for these two resultants are shown in dotted lines in FIG. 10.

Figure 12:
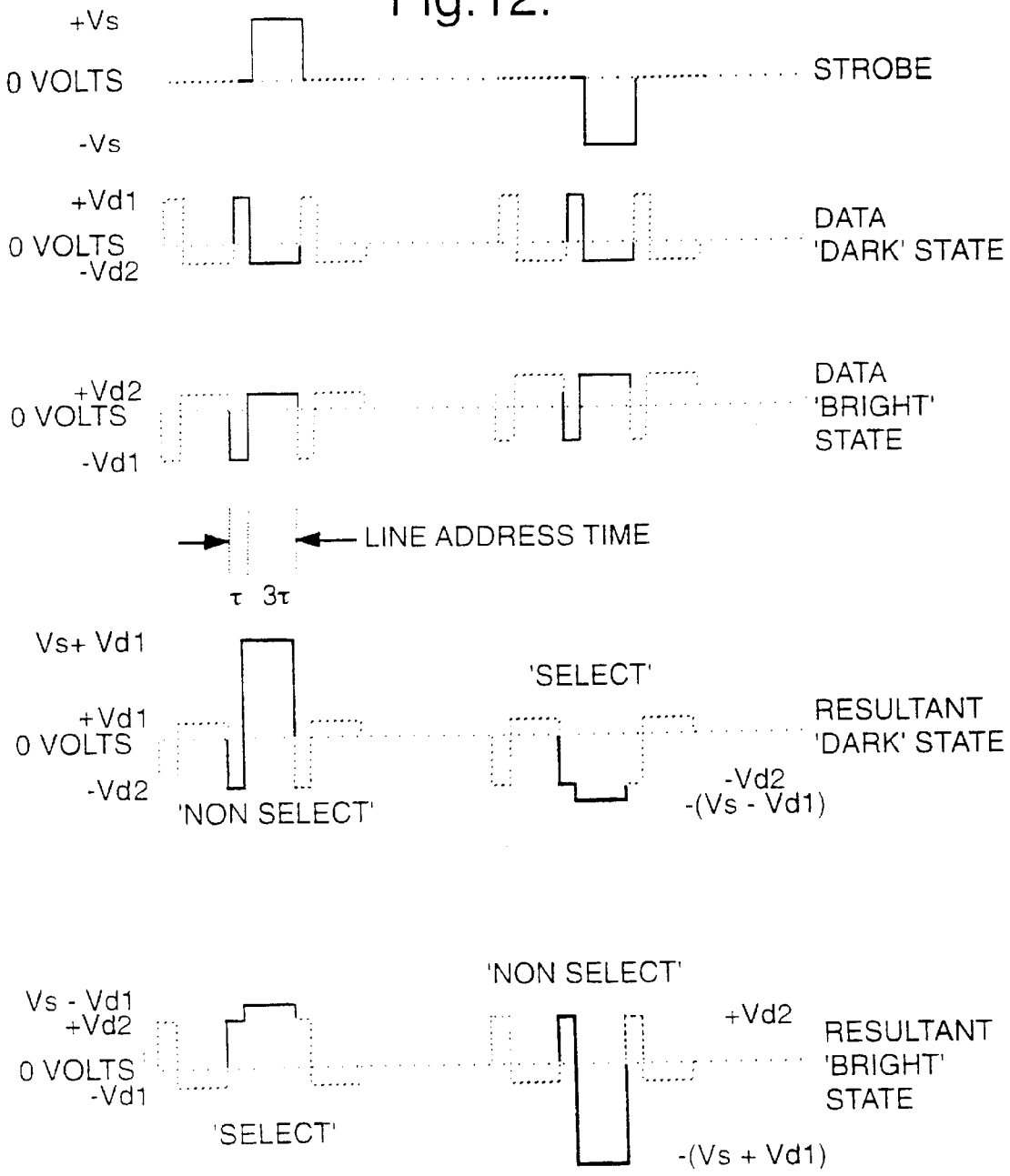
FIGS. 12, 12*a* show strobe, data, and resultant waveform for two 4-slot schemes of the present invention.

FIG. 12 shows an addressing scheme, a four slot scheme, of the present invention. Strobe and data waveforms present during one line address time (ie 4ts) are shown in full lines; the strobe is zero outside the line address period; the data may be either select 'dark' or select 'bright' in other line address periods and only one possibility is shown. The strobe waveform is zero in the first time slot (ts1) and $V_s$ for the next four time slots ts2–ts4. Non-select or dark state data is +Vd1 for ts1, and −Vd2 for ts2–ts4; Vd1=3xVd2 in this example. Select or bright state data is −Vd1 for ts1 and +Vd2 for ts2–ts4. Resultant waveforms (C, & D) are −Vd2, Vs+Vd1, and +Vd2, Vs−Vd1 (and the opposite polarities) for non-select and select respectively. FIG. 10 shows switching characteristics for these resultants and marked C and D. Varying the data waveforms from that of FIG. 11 to that of FIG. 12 is seen to change, ie lower, the switching time for a given voltage.

Figure 12A:
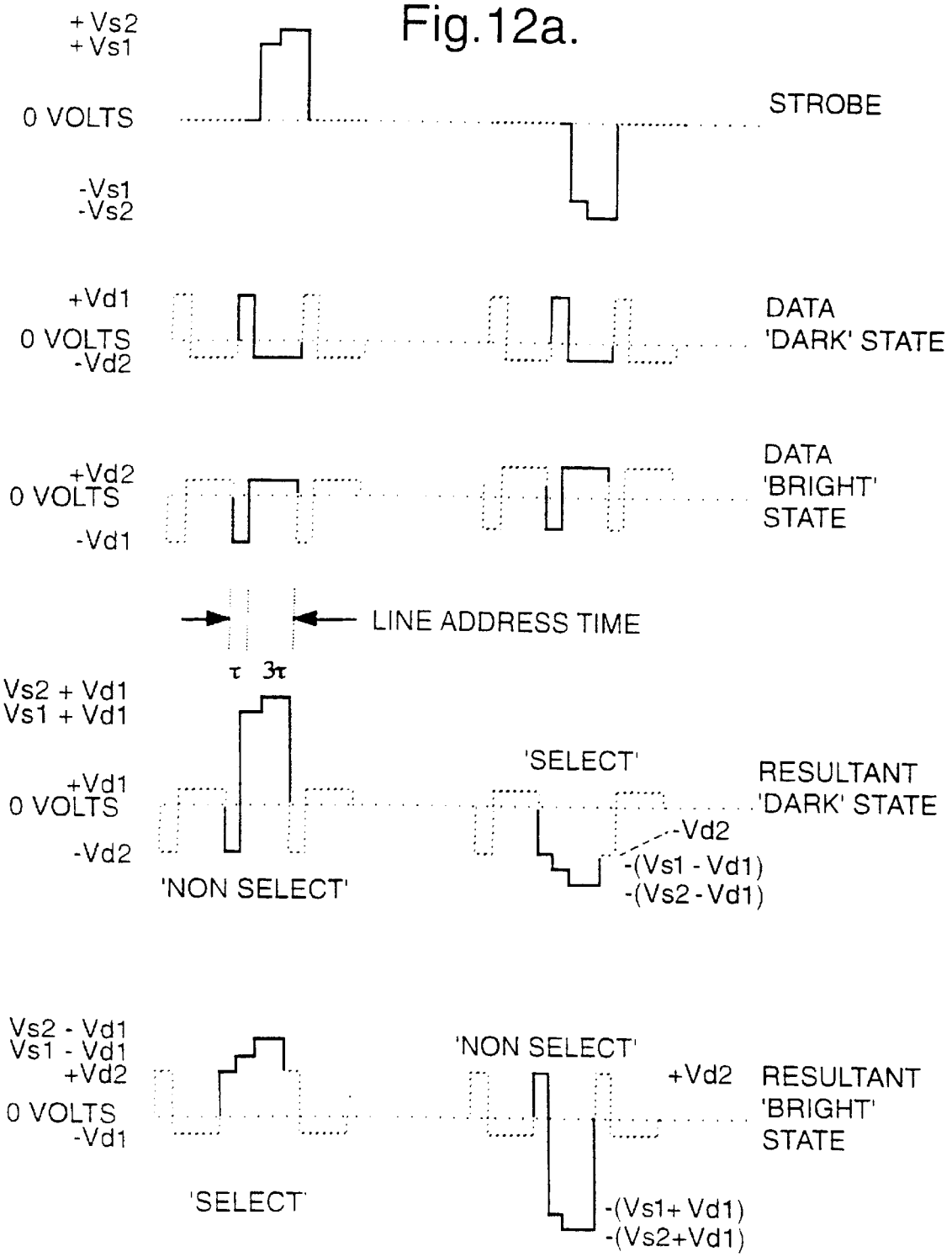
Figure 13:
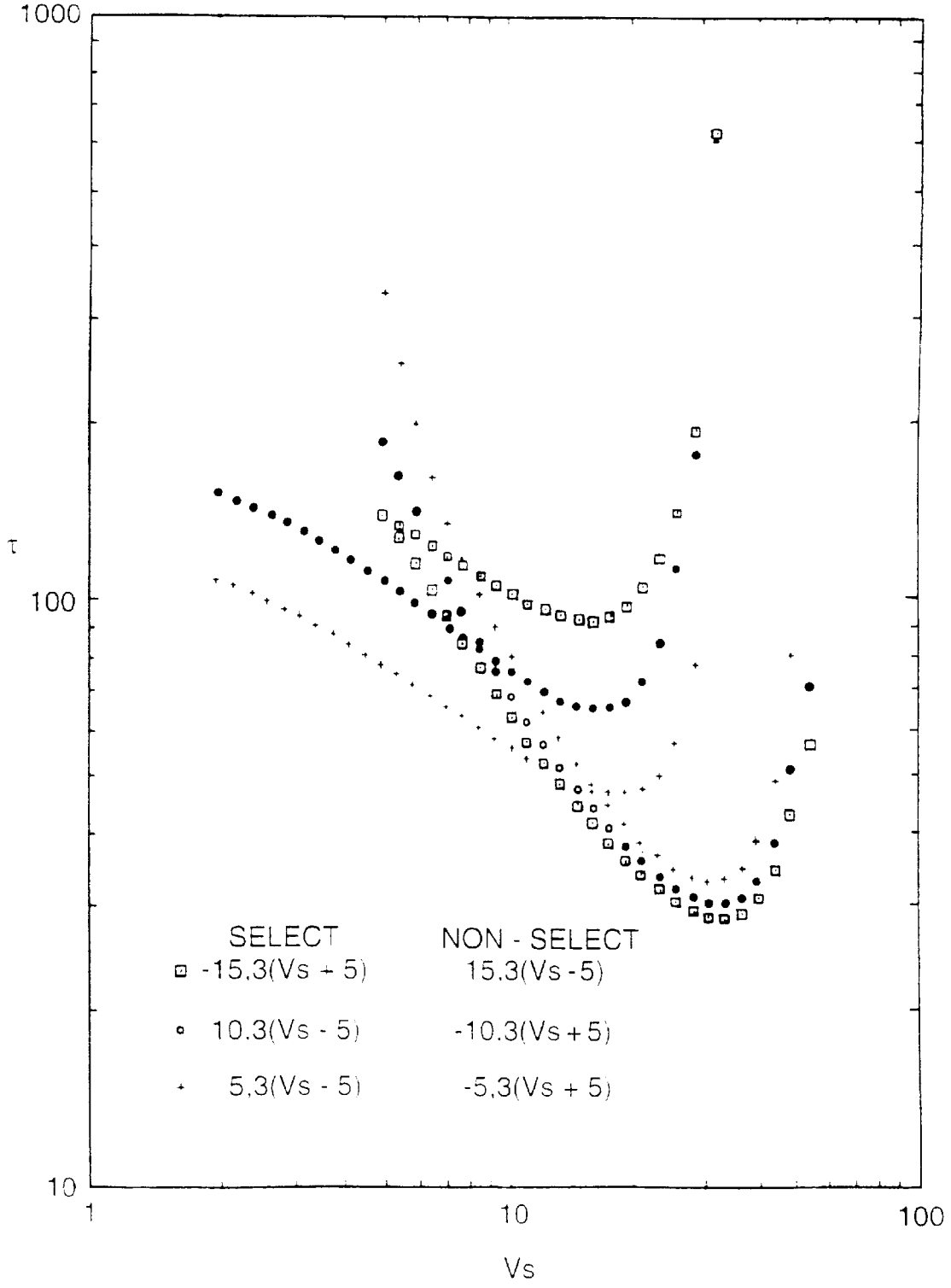
FIGS. 13–16 show switching characteristics for different shapes of a 4-slot scheme.
Figure 14:
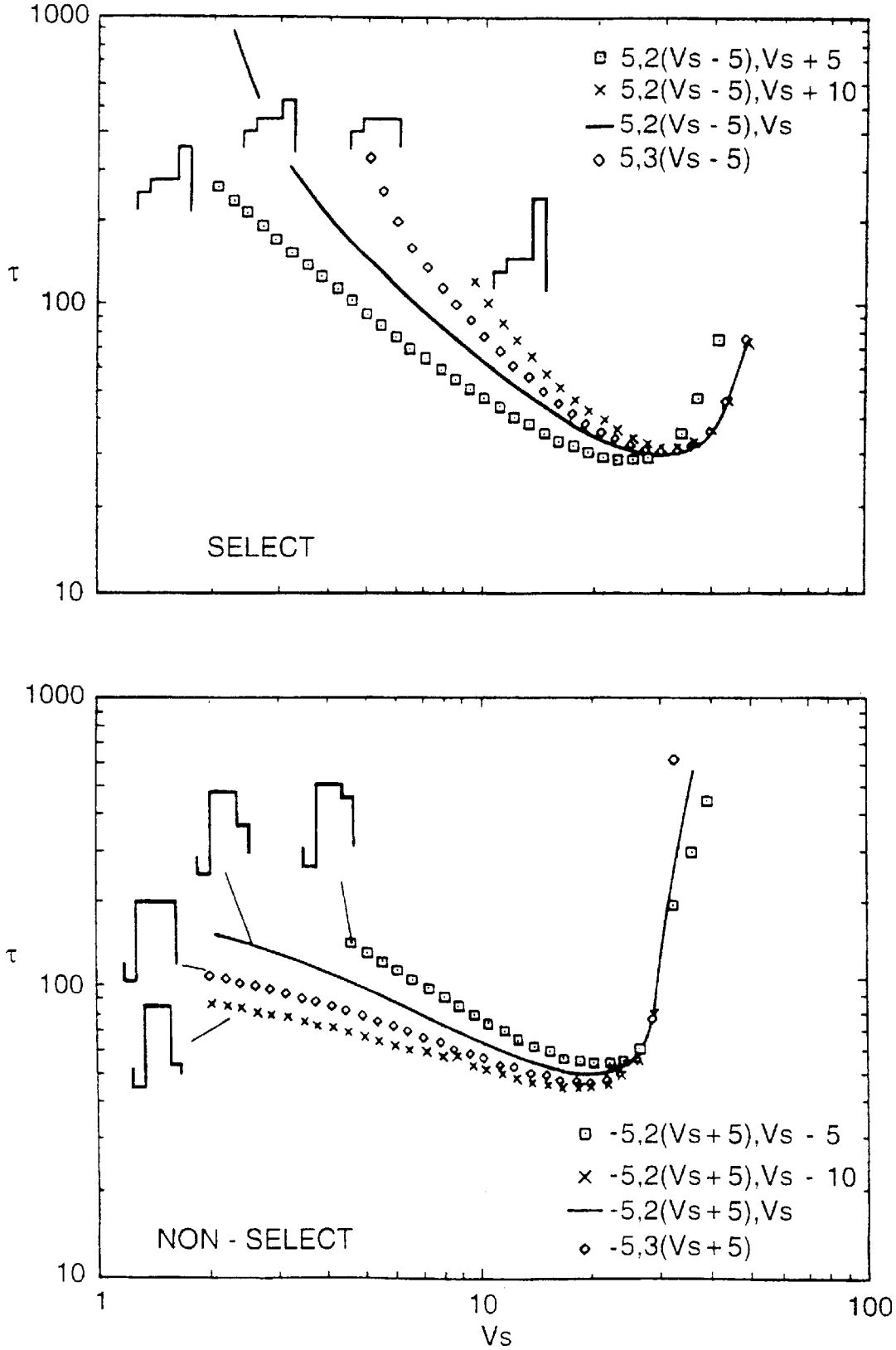
Figure 15:
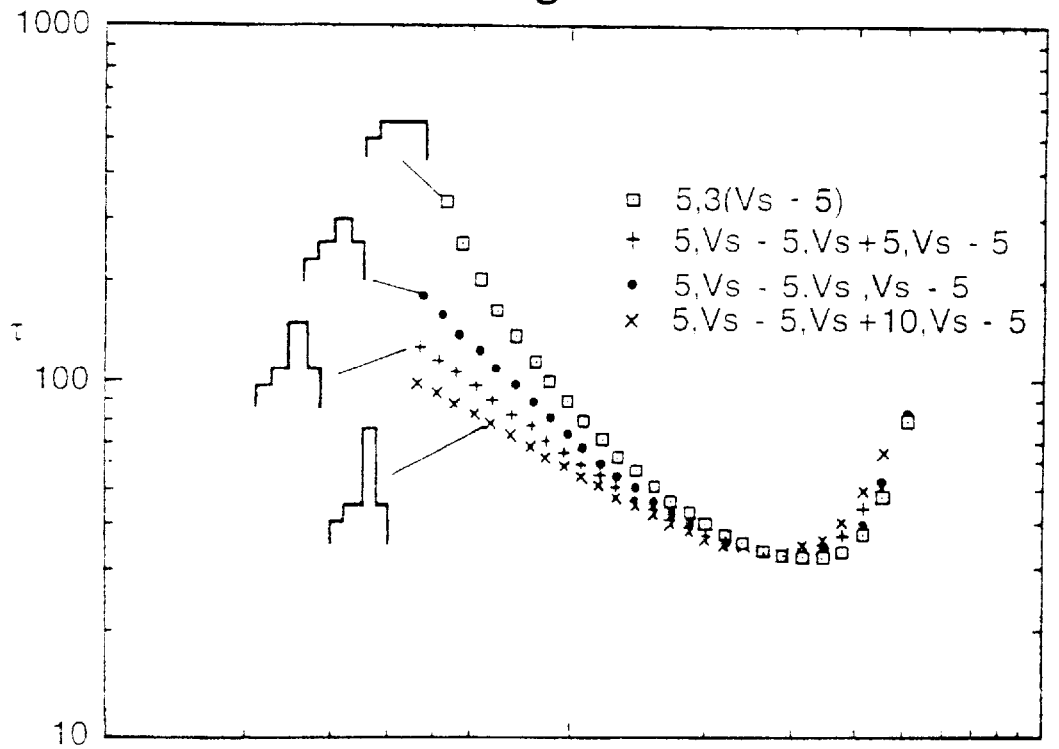
Figure 15:
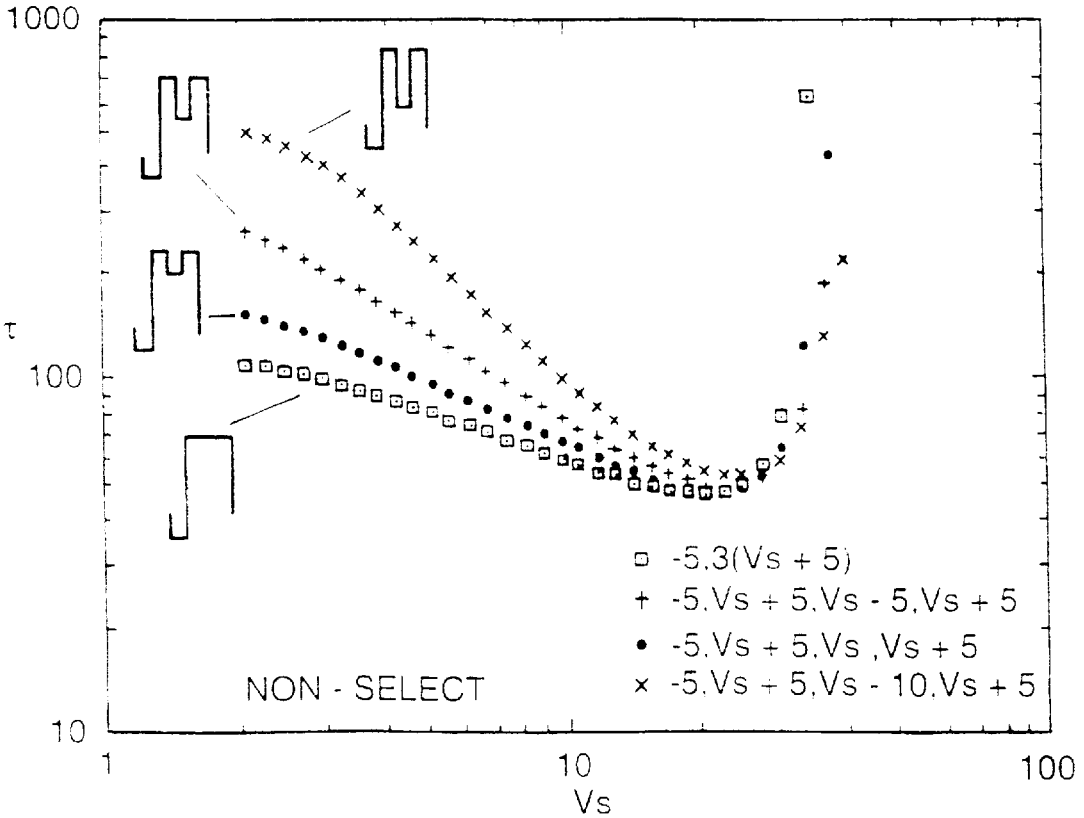
Figure 16:
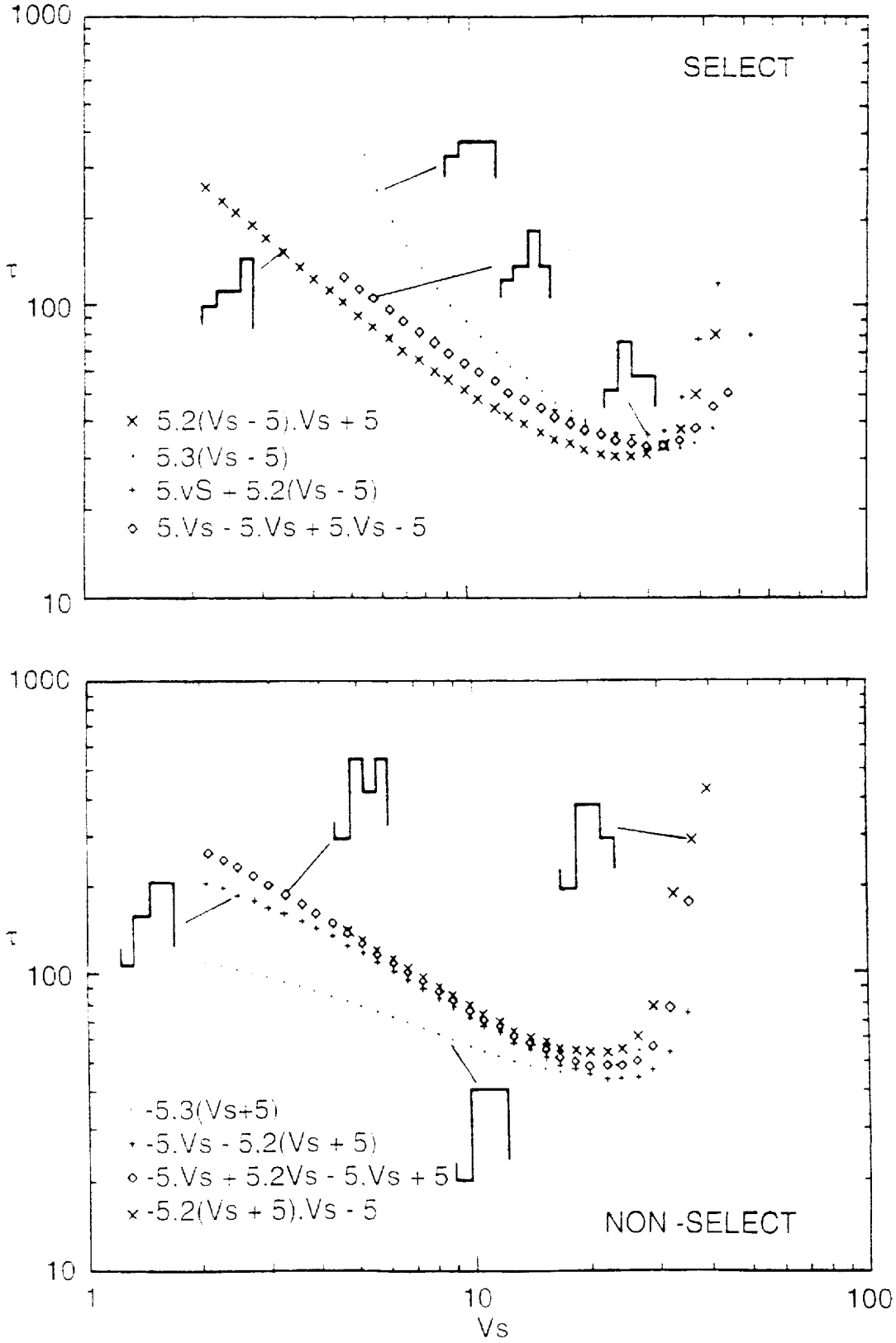

FIG. 12*a* shows a modification of the 4-slot scheme shown in FIG. 12. In FIG. 18*a* the strobe is 0, +Vs1, +Vs2, +Vs2, in a first field time followed by the inverse in a second field time. The two data waveforms are as in FIG. 12, Vd1=3xVd2. Resultant waveforms are as shown and are closer to those shown in FIGS. 8, 9 than those of FIG. 12. Non-select resultants are: −Vd2, +Vs1+Vd1, Vs2+Vd1, Vs2+Vd1 and the opposite polarity. Select resultants are: −Vd2, −(Vs1−Vd1), −(Vs2−Vd1), −(Vs2−Vd1), and the opposite polarity.

The shape of the data waveforms varies the τV curves considerably. FIGS. 13–16 show respectively the effect of varying the amplitude of the first of the four pulses; varying the fourth; varying the third; and varying the position of the $V_s+V_d$ pulse within the four time slots.

The above FIGS. 10 to 16 describe 4-slot drive schemes, and compares them with prior art 2-slot schemes. The present invention may use less than or more than 4-slots, with either odd or even numbers of slots. For example 3-slots, 6-slots and 8-slots.

Figure 17:
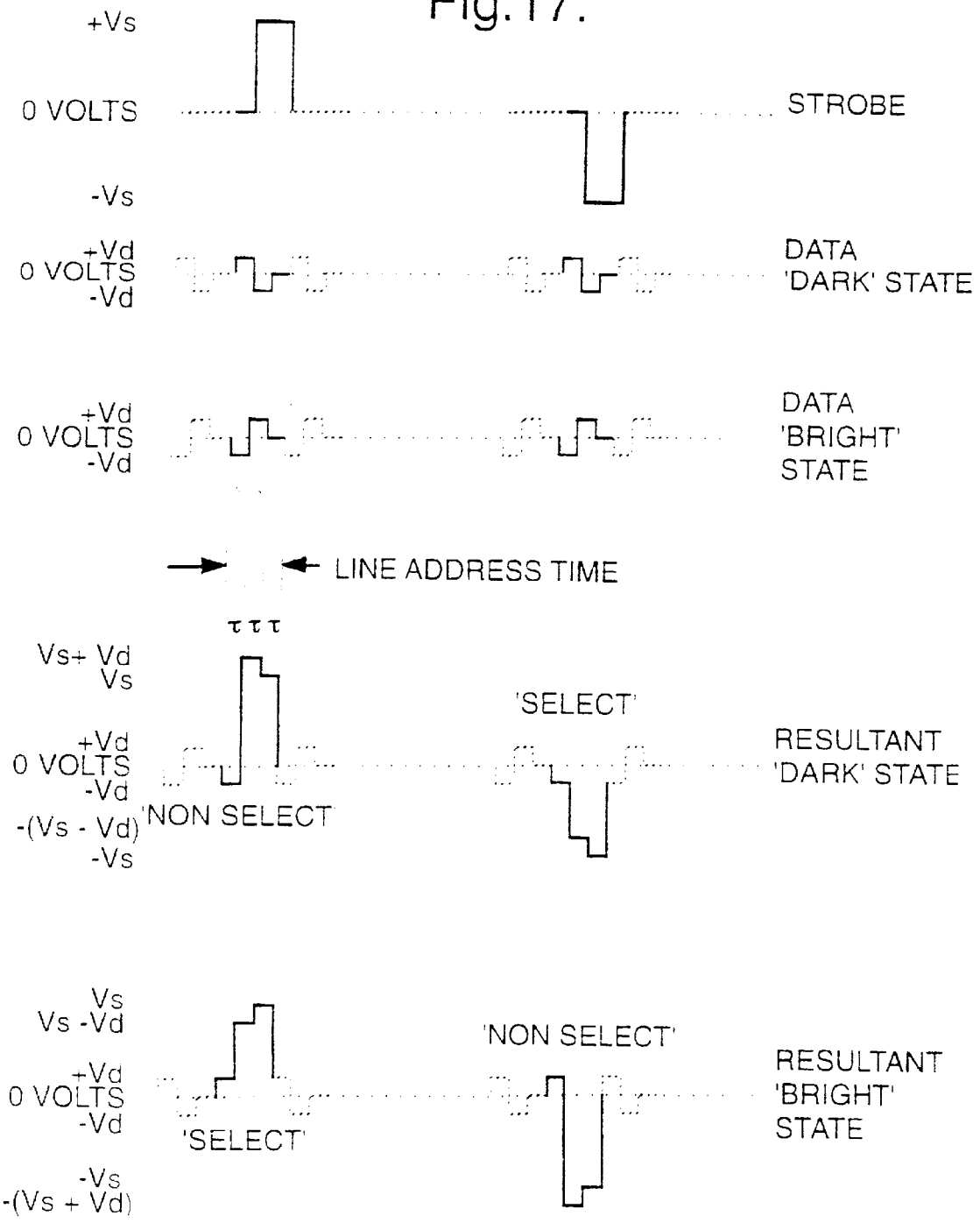
FIG. 17 shows strobe, data, and resultant waveform for a 3-slot scheme.

FIG. 17 shows a 3-slot scheme where the strobe pulses are 0, $V_s$, $V_s$ in time slots ts1, ts2, ts3. This is followed by the inverse polarity for a second field time. Dark state data pulses are $+V_d$, $-V_d$ and 0 in the three slots. Bright state data pulses are −Vd, +Vd, and 0 in the three time slots. The line address time for a 3-slot scheme is 3ts. Resultant voltages for a positive strobe and a dark state data are shown as −Vd, Vs+Vd, Vs which does not cause a switching. Resultant of the positive strobe and light state data are Vd, Vs−Vd, Vs which causes switching. The inverse applies to the negative strobe in the second field time as shown.

As in GB-2,262,831, the strobe waveform may be extended in time into the line address of the next row, eg the strobe waveform may be 0, $V_s$, $V_s$, $V_s$. More than two voltage levels may be used in the strobe waveform.

Figure 18:
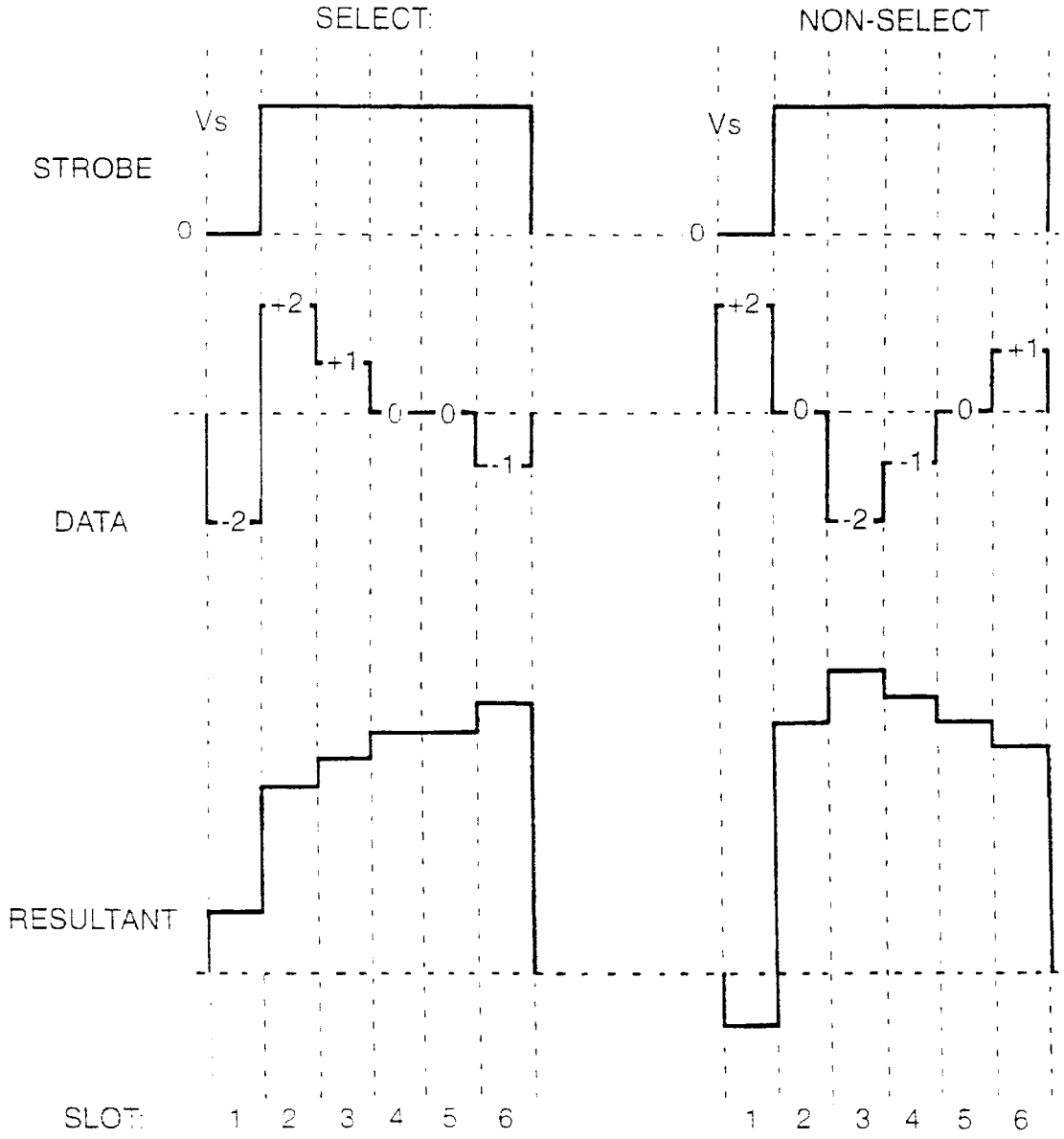
FIG. 18 shows strobe, data, and resultant waveforms for a 6-slot scheme.

Strobe and Data (2) waveforms for a 6-slot scheme are shown in FIG. 18. The strobe pulses are 0 in ts1, and $+V_s$ in ts2 to ts6 for application in a first field time. Data pulses giving a switching are −2, +2, +1, 0, 0, −1 in ts1 to ts6. Non-switching data pulses are +2, 0, −2, −1, 0, +1 in ts1 to ts6. The shape of the strobe waveform used in a second field time are not shown but are the inverse of the shown strobe.

Figure 19:
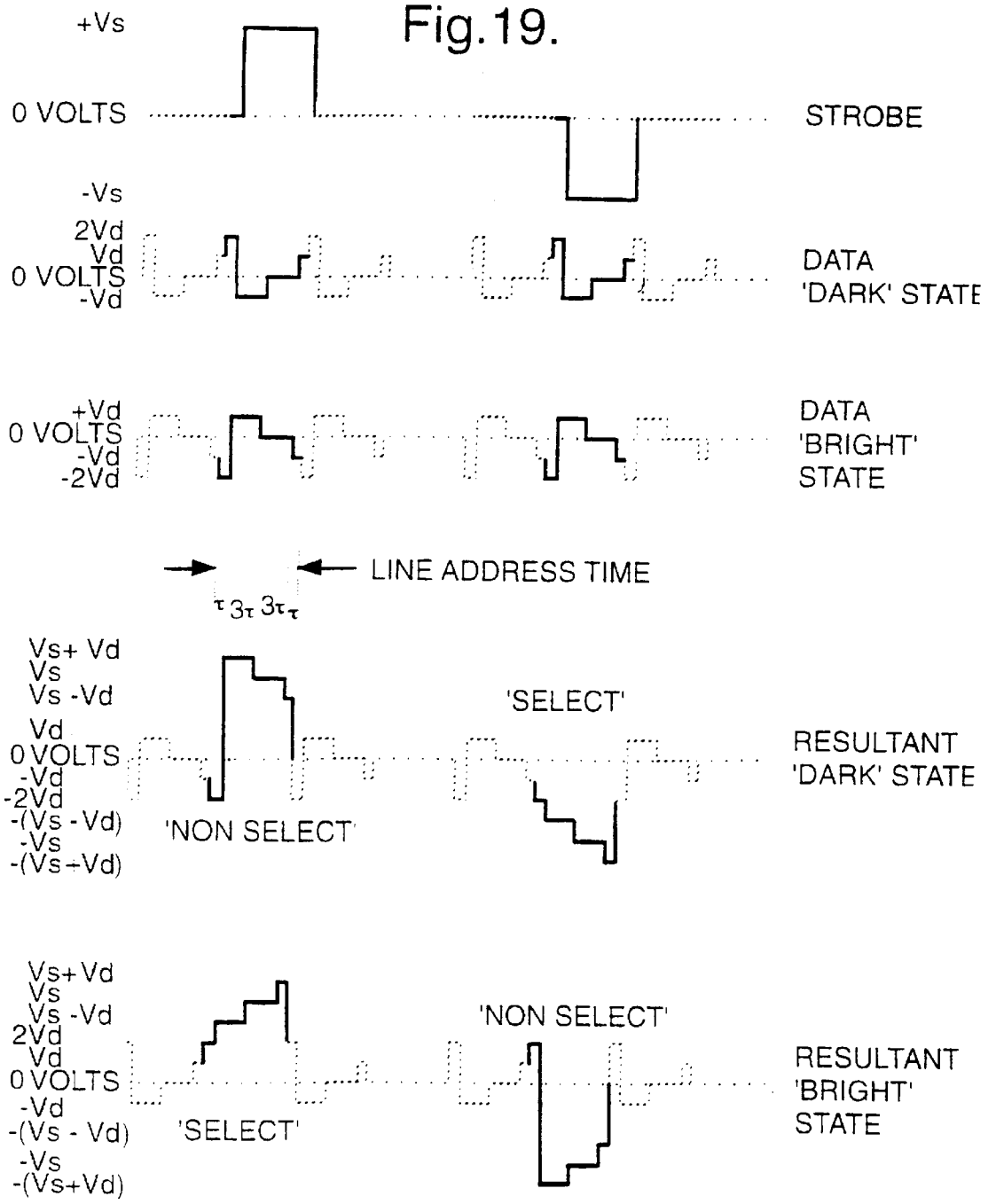
FIG. 19 shows strobe, data, and resultant waveforms for a 8-slot scheme.

FIG. 19 shows an 8-slot scheme, strobe and data waveform present during one line address time are shown in full lines; the strobe is zero outside the line address period; the data may be either select 'dark' or select 'bright' in other line address periods and only one possibility is shown. The first field time strobe waveform is 0 in ts, and $V_s$ in ts2–ts8, and the second field strobe is the inverse. Dark state data waveform has pulses $-2V_d$, $-V_d$, $-V_d$, $-V_d$, 0, 0, 0, $+V_d$. Bright state data waveform has pulses $-2V_d$, $+V_d$, $+V_d$, $+V_d$, 0, 0, 0, $-V_d$ in ts1–ts8. More than two levels of strobe and more than three levels of data pulses may be used. The non-switching resultant of a positive strobe and a dark state data is −(Vs−Vd), Vs+Vd, Vs+Vd, Vs+Vd, Vs, Vs, Vs, Vs−Vd. The switching resultant of a positive strobe and a bright state data is 2Vd, Vs−Vd, Vs−Vd, Vs−Vd, Vs, Vs, Vs, Vs+Vd. Note the similarity to the resultants in FIGS. 8,9.

Figure 20:
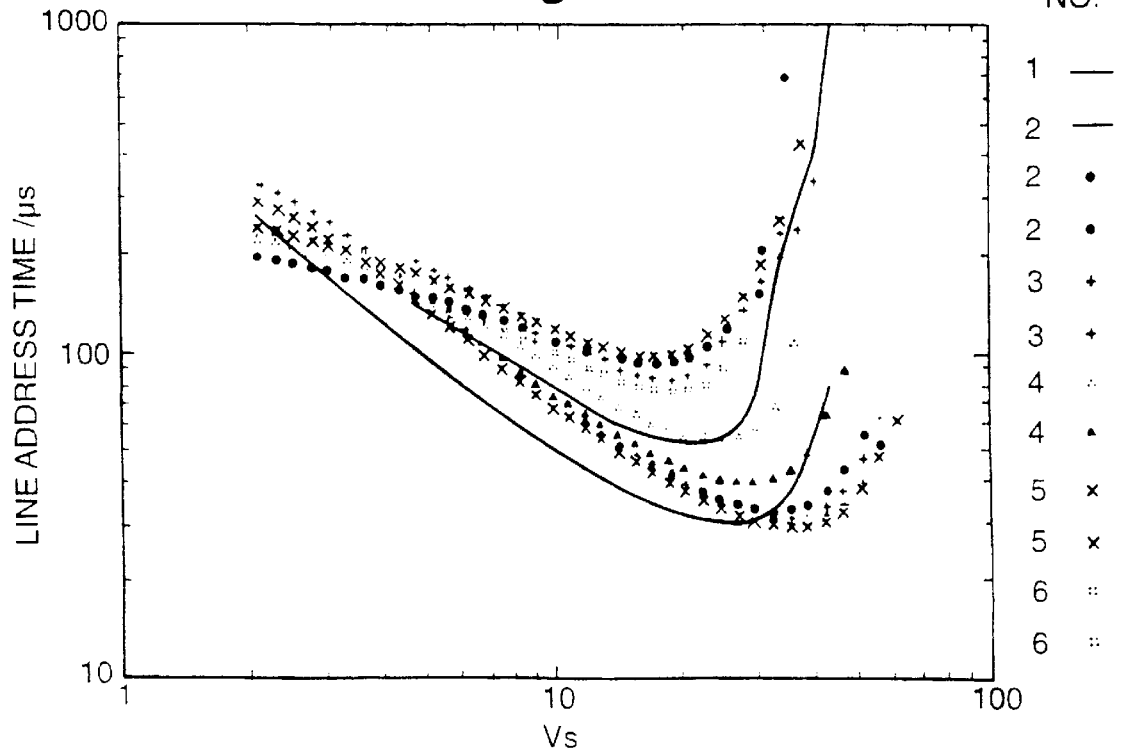
FIG. 20 shows switching characteristics for a 3-slot scheme of FIG. 17.

FIG. 20 shows the effect of varying the amplitudes and relative amplitudes on τV for a 3-slot scheme. The following non-select and select resultant voltages were used to produce the curves shown:

| | Resultant V Nos are in arbitrary units | |
|---|---|---|
| Sample No. | Switching. | Non-switching |
| 1 | 5, $V_s - 5$, $V_s - 5$, $V_s + 5$ | $-5$, $V_s + 5$, $V_s + 5$, $V_s - 5$ |
| 2 | 10, $V_s - 5$, $V_s - 5$ | $-10$, $V_s + 5$, $V_s + 5$ |
| 3 | 5, $V_s - 10$, $V_s + 5$ | $-5$, $V_s + 10$, $V_s - 5$ |
| 4 | 5, $V_s + 5$, $V_s - 10$ | $-5$, $V_s - 5$, $V_s + 10$ |
| 5 | 8.66, $V_s - 8.66$, $V_s$ | $-8.66$, $V_s + 8.66$, $V_s$ |
| 6 | 8.66, $V_s$, $V_s - 8.66$ | $-8.66$, $V_s$, $V_s + 8.66$ |

Note:
any one of the non-switching resultants can be used with any one of the switching resultants, providing they are matched to give the same rms values.

Figure 21:
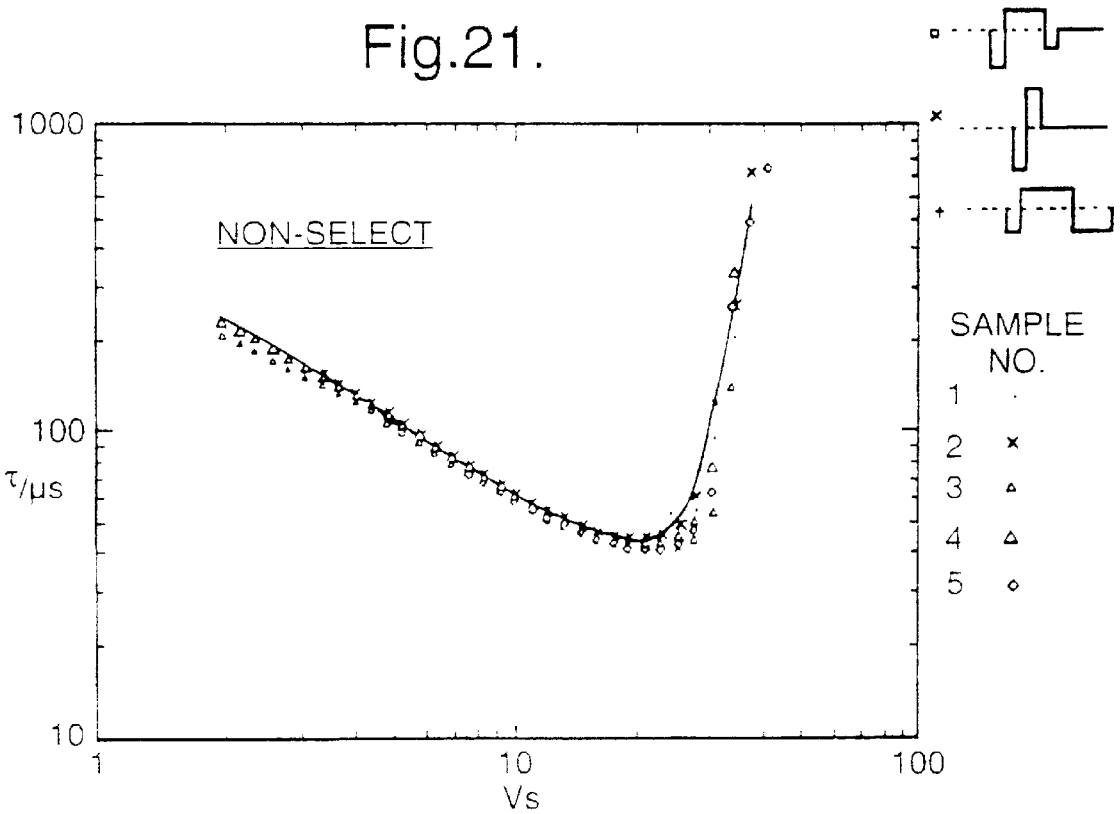
FIGS. 21–22 show switching characteristics for non-select and select resultant waveforms for the 8-slot scheme of FIG. 19.

FIG. 21 shows the τV characteristics for an 8-slot scheme with the following non-select resultant voltages:

| Sample No | Resultant in successive ts | | | | | | | |
|---|---|---|---|---|---|---|---|---|
| 1 | −2 | 1 | 1 | 1 | −1 | 0 | 0 | 0 |
| 2 | −2 | 1 | 1 | 1 | 0 | 0 | 0 | −1 |

-continued

| Sample No | Resultant in successive ts | | | | | | | |
|---|---|---|---|---|---|---|---|---|
| 3 | −2 | 1 | −1 | 0 | 0 | 0 | 1 | 1 |
| 4 | −2 | 1 | −1 | 1 | 1 | 0 | 0 | 0 |
| 5 | −1 | 1 | 1 | 1 | 0 | 0 | 0 | −2 |

Example 2 has the best characteristics.

Figure 22:
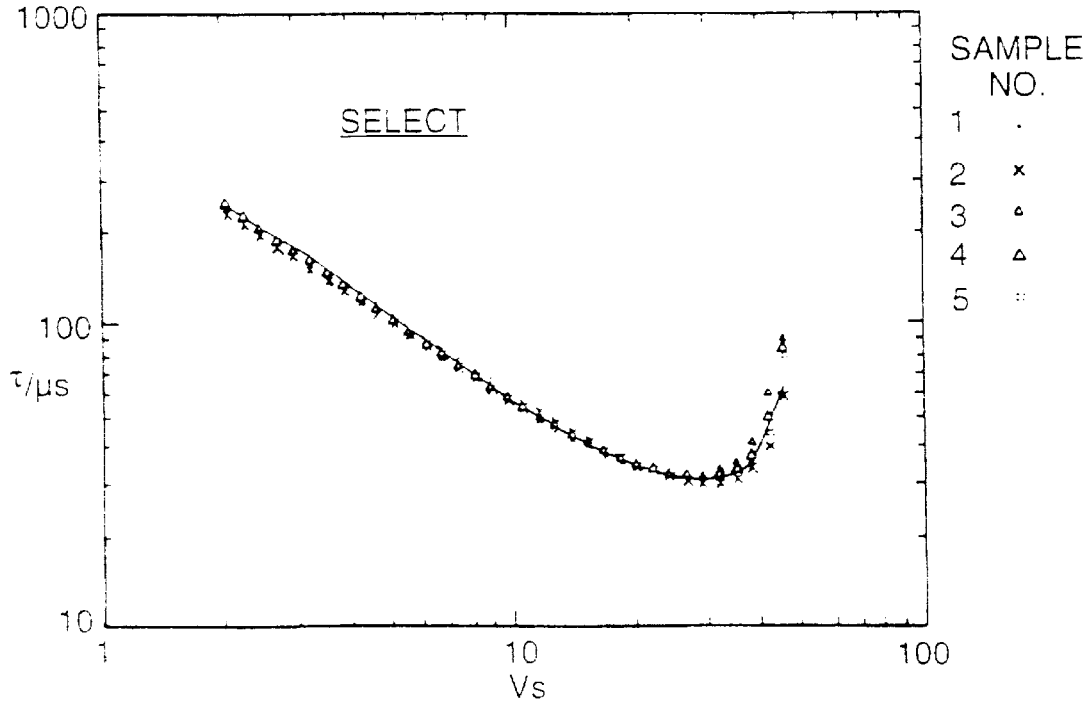

FIG. 22 shows the τV characteristics for an 8-slot scheme as in FIG. 19 with the following select resultant voltages:

| Sample | Resultant | | | | | | | |
|---|---|---|---|---|---|---|---|---|
| 1 | 2 | −1 | −1 | −1 | 1 | 0 | 0 | 0 |
| 2 | 2 | −1 | −1 | 1 | 0 | 0 | 0 | 1 |
| 3 | 2 | −1 | 1 | 0 | 0 | 0 | −1 | −1 |
| 4 | 2 | −1 | 1 | −1 | −1 | 0 | 0 | 0 |
| 5 | 1 | −1 | −1 | −1 | 0 | 0 | 0 | 2 |

Sample 2 has the best characteristics.

Addressing schemes of the present invention require generation of two data waveforms that may not be of similar shape but opposite polarity as in some prior art schemes.

Alternatively to the above two field schemes, pixels may be blanked to one state then selectively switched to the other state. Such blanking may be one or more rows at a time and may be several rows ahead of the selective addressing.

Figure 23:
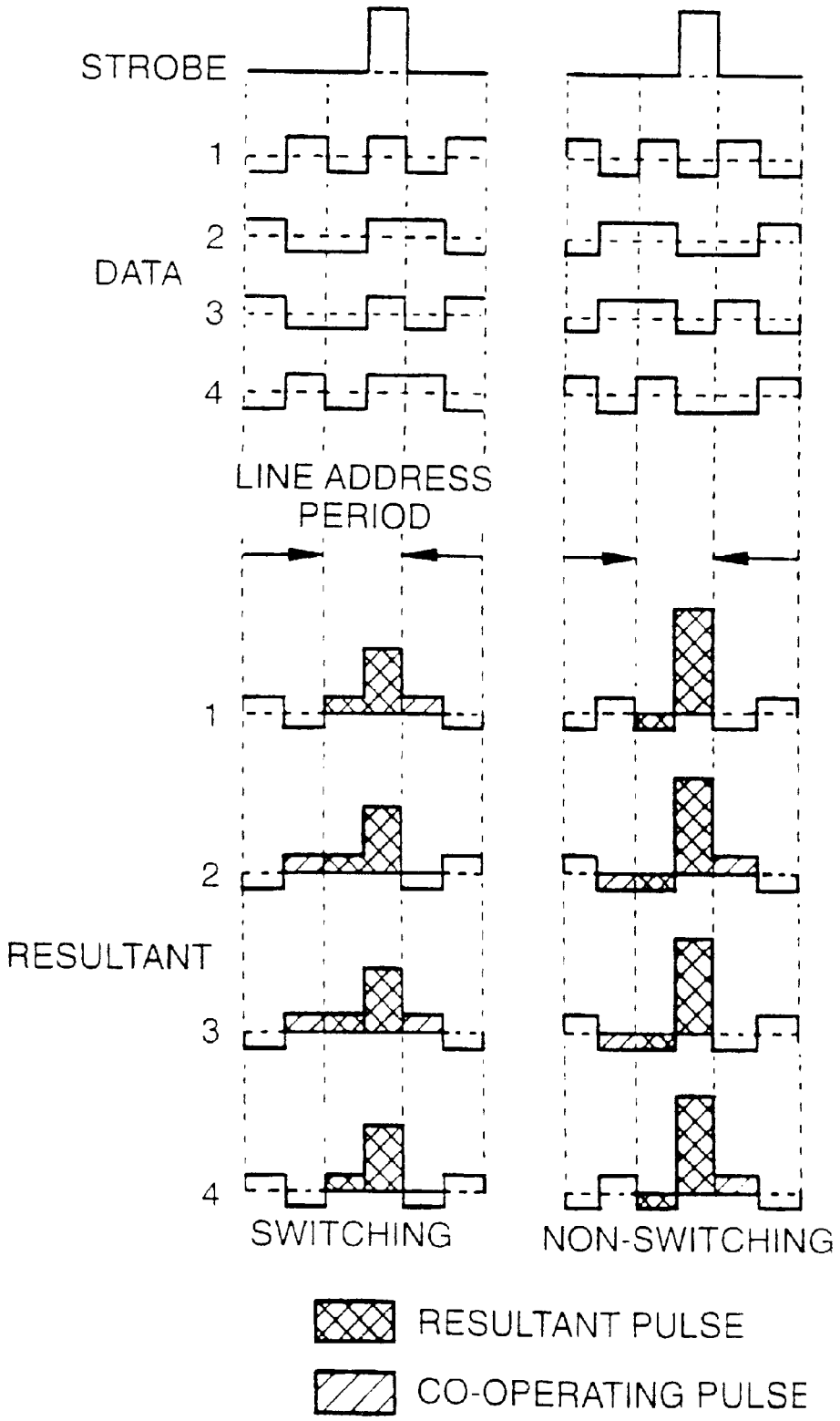
FIG. 23 shows line address time against Vs/V for a prior art addressing scheme for different pixel patterns of display.
Figure 24:
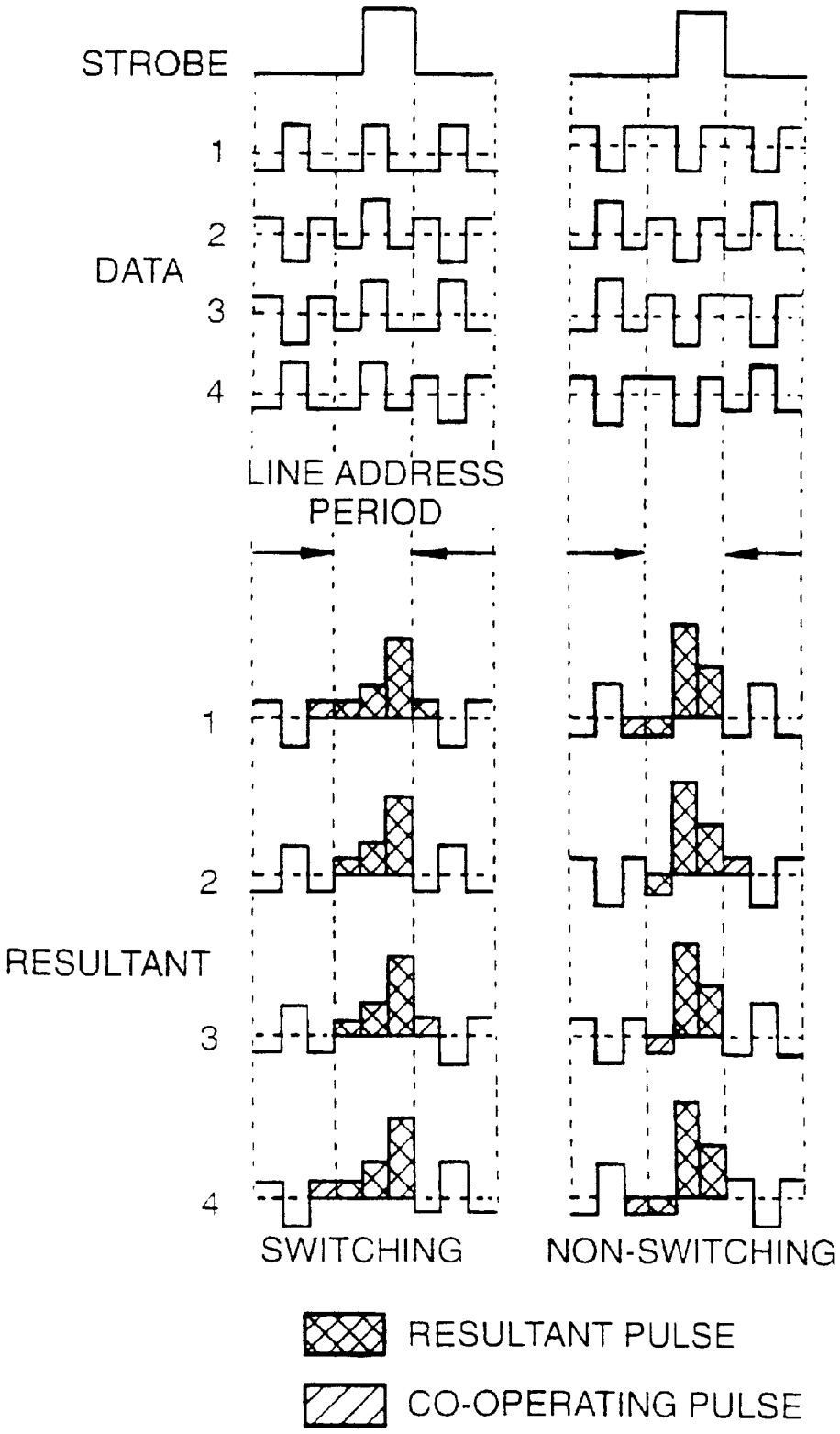
FIG. 24 shows lines address time against Vs/V for a three slot addressing scheme of this invention for different pixel patterns of display.

When address a display, the pattern of pixels has an effect on the switching of pixels, ie the voltages applied either side of a line being addressed. FIGS. 23, 24 show two different address schemes addressing four different pixel patterns, four different combinations of data waveforms are shown. FIG. 23 is the address scheme shown in FIG. 11, and FIG. 24 is a 3-slot scheme of the present invention. Three line address periods are shown, the centre one is the same for all data combinations but the data and resultant either side of this centre period varies with pixel pattern. The four different data waveforms are the different possible combinations of data on either side of the line address period. The resultants (shown in cross hatch) are the combination of the strobe and data waveform for the four different pixel patterns. The co-operating pulses (shown in hatched) are those data waveforms which combine with the resultant pulse to aid it.

Figure 25:
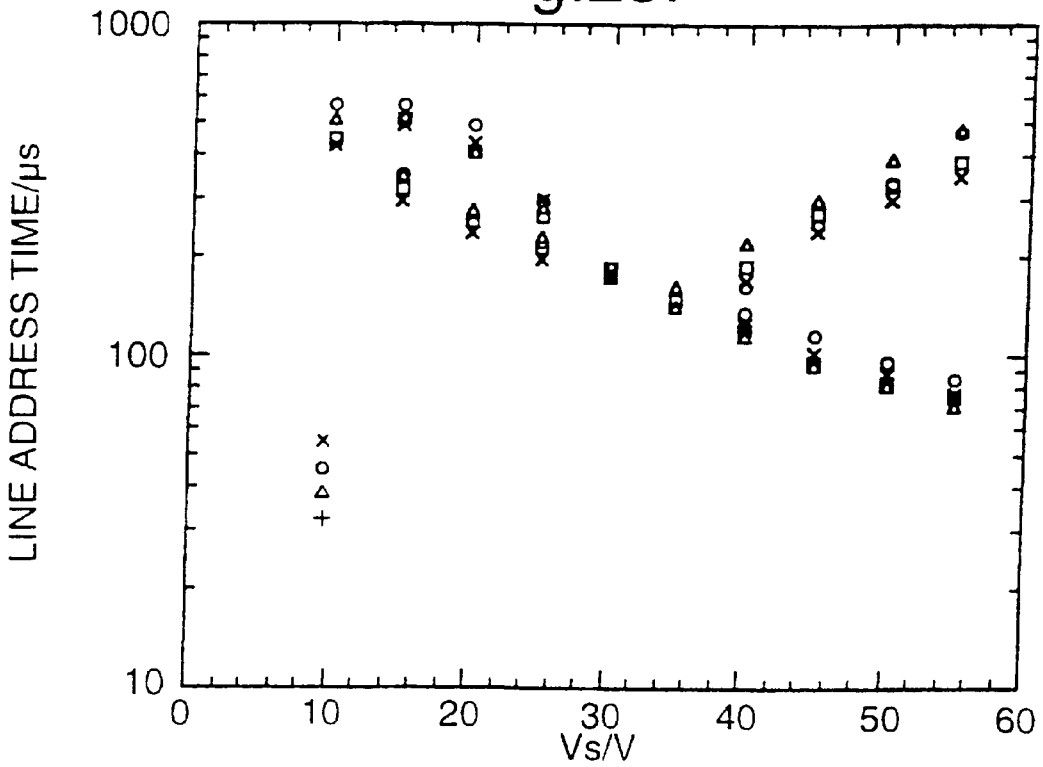
FIG. 25 shows switching characteristic for a device addressed by a scheme as in FIG. 11.
Figure 26:
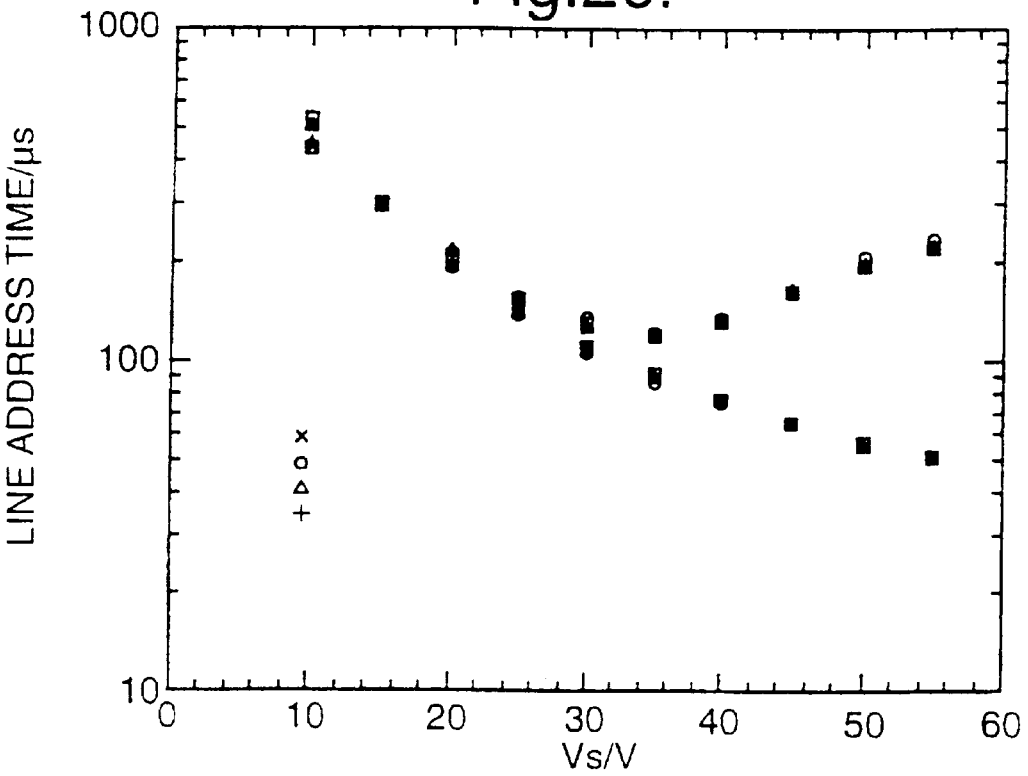
FIG. 26 shows switching characteristics for a device addressed by the present invention, the effects of different pixel patterns on switching points.

FIGS. 25, 26 show switching characteristics for a prior art scheme of FIG. 11 and the 3-slot scheme (FIG. 24) of the present invention respectively. In FIG. 25 there is considerable scatter in the graphs indicating a wide variation of switching for different pixel patterns, ie the pattern of bright and dark pixels influences the time voltage product required to switch a given pixel. In contrast FIG. 26 shows little scatter in switching for different pixel patterns. This results in an improved display appearance. The fastest line address time for the prior art is about 85 μs whilst that for FIG. 26 is about 50 μs. The graphs of FIG. 26 are experimental results obtained for a cell filled with ZLI-5014-000 (obtained from E Merck, FRG), the layer was 1.8 μm thick, between parallel rubbed (in the same direction) polyimide surfaces, measurement taken at 25° C.

One suitable liquid crystal material is ZLI-5014-000 which has a measured Ps of 2.88 $nCcm^{-2}$ ($=2.88\times10^{-5}$ $cm^{-2}$) and an estimated dielectric biaxiality $\partial\epsilon$ of 0.2 at 25° C.

We claim:

1. A method of multiplex addressing a bistable liquid crystal display capable of being switched between two stable states, said display comprising a matrix of addressable pixels formed by the intersections of a plurality of electrodes in a first set of electrodes and a plurality of electrodes in a second set of electrodes within the liquid crystal cell, the method comprising the steps of:

generating and applying to each electrode in the first set in a sequence a strobe waveform for an addressing period, generating and applying to each electrode in the second set one of two data waveforms in each addressing period, generating two differently shaped data waveforms having at least two different amplitude voltage levels with a period of at least three time slots (3ts) forming the addressing period, the two data waveforms having dc balance and equivalent rms values within the addressing period, and generating a strobe waveform of at least two voltage levels that co-operates with the two data waveforms to produce switching and non-switching resultant waveforms each lasting at last an addressing period;

the switching resultant waveform having at least two different voltage levels of the same polarity in each addressing period with the voltage level in the first time slot having a lower amplitude than the level in the second time slot and the voltage level in subsequent time slots of each addressing period not less than the level in the second time slot;

the non-switching resultant waveform having a first voltage level in the first time slot of opposite polarity to the voltage in the second time slot.

2. The method of claim 1 wherein the switching resultant has three or more voltage levels that increase in amplitude but the same polarity in successive time slots during the address period.

3. The method of claim 1 wherein the non-switching resultant has a voltage level in the second and or third time slot of an addressing period that is of suitable amplitude to inhibit switching.

4. The method of claim 1 wherein the non-switching resultant has different voltage levels in the first and second time slots of the addressing periods.

5. The method of claim 1 wherein the value of the ratio of spontaneous polarisation (Ps) and dielectric biaxiality ($\partial\in$) is less than 0.01 $Cm^{-2}$.

6. The method of claim 1 wherein the value of the ratio of spontaneous polarisation (Ps) and dielectric biaxiality ($\partial\in$) is less than 0.001 $Cm^{-2}$.

7. The method of claim 1 wherein the data waveforms have more than two voltage levels.

8. The method of claim 1 wherein the strobe waveform has more than two voltage levels.

9. The method of claim 1 wherein the shape of the resultant is varied with temperature variation of the cell.

10. The method of claim 1 wherein the strobe waveform is extended into the line address period of a different electrode to provide temperature compensation.

11. The method of claim 1 wherein the first level of the strobe waveform is varied to provide temperature compensation.

12. The method of claim 1 wherein the strobe waveform is a waveform of one polarity followed by a waveform of the opposite polarity and the display is addressed in two field addressing times.

13. The method of claim 1 wherein the strobe waveform is a blanking waveform that causes a switching irrespective of a data waveform, followed by a strobe that co-operates with a data waveform to effect a switching.

14. The method of claim 7 wherein the blanking and strobe waveforms are DC balanced.

15. The method of claim 1 wherein the shape of the data waveform is arranged to provide ac stabilisation.

16. A multiplex addressable bistable liquid crystal display capable of being switched between two stable states, said display comprising:

a layer of chiral smectic liquid crystal material contained between two cell walls, both surface treated to align the liquid crystal material, a first series of spaced strip (row) electrodes on one wall and a second series of spaced (column) strip electrodes on the other wall arranged to provide a matrix of addressable elements (pixels), driver circuits for applying a strobe waveform to the first set of electrodes in sequence, and for applying one of two data waveforms (select and non-select) to the electrodes in the second set of electrodes, means for generating a select and non-select data waveform having at least two voltage levels with a period of at least three time slots (3ts) forming an addressing period, the two data waveforms having dc balance and equivalent rms. values, means for generating a strobe waveform, the two data and the strobe waveforms co-operating to provide switching and non-switching resultant waveforms that vary during the addressing period to improve torque on material molecules being switched and reduce torque on molecules not being switched; the switching resultant waveform having at least two different voltage levels of the same polarity in each addressing period with the voltage level in the first time slot having a lower amplitude than the level in the second time slot and the voltage level in subsequent time slots of each addressing period not less than the level in the second time slot.

17. The display of claim 16 wherein the data waveforms have more than two voltage levels.

18. The display of claim 16 wherein the strobe waveform has two or more voltage levels.

19. The display of claim 16 wherein the two data waveforms are of different shape.

20. The method of claim 1, wherein said bistable liquid crystal display is a ferroelectric liquid crystal display.

21. The display of claim 16, wherein said bistable liquid crystal display is a ferroelectric liquid crystal display.

* * * * *

UNITED STATES PATENT AND TRADEMARK OFFICE

CERTIFICATE OF CORRECTION

PATENT NO. : 6,127,996
DATED : October 3, 2000
INVENTOR(S) : JONES et al

It is certified that error appears in the above-identified patent and that said letters patent is hereby corrected as shown below:

Column 13, line 21, "at last" should read --at least--.

Column 14, line 12, "claim 7 wherein" should read --claim 13 wherein--.

Signed and Sealed this

Eighth Day of May, 2001

*Attest:*

Nicholas P. Godici

NICHOLAS P. GODICI

*Attesting Officer*

*Acting Director of the United States Patent and Trademark Office*